US008745932B2

(12) United States Patent
Fisher

(10) Patent No.: US 8,745,932 B2
(45) Date of Patent: Jun. 10, 2014

(54) INTERMENT SYSTEM

(76) Inventor: Brian Kenneth Fisher, Manchester (GB)

( * ) Notice: Subject to any disclaimer, the term of this patent is extended or adjusted under 35 U.S.C. 154(b) by 0 days.

(21) Appl. No.: 13/702,392

(22) PCT Filed: Jun. 13, 2011

(86) PCT No.: PCT/GB2011/000878

§ 371 (c)(1),
(2), (4) Date: Mar. 4, 2013

(87) PCT Pub. No.: WO2011/154707

PCT Pub. Date: Dec. 15, 2011

(65) Prior Publication Data

US 2013/0152488 A1 Jun. 20, 2013

Related U.S. Application Data

(60) Provisional application No. 61/354,828, filed on Jun. 15, 2010.

(30) Foreign Application Priority Data

Jun. 11, 2010 (GB) ..... 1009771.5
Jun. 15, 2010 (GB) ..... 1009994.3
Jun. 10, 2011 (GB) ..... 1109768.0

(51) Int. Cl.
*E04H 13/00* (2006.01)

(52) U.S. Cl.
USPC ..... 52/133; 52/124.1

(58) Field of Classification Search
USPC ..... 52/132–136, 142, 124.1, 124.2; 27/35
See application file for complete search history.

(56) References Cited

U.S. PATENT DOCUMENTS

| | | | | |
|---|---|---|---|---|
| 983,804 | A | 2/1911 | Bermel | |
| 3,772,826 | A | 11/1973 | Ferver | |
| 3,898,718 | A | 8/1975 | Eubank | |
| 4,862,655 | A * | 9/1989 | LePage et al. | 52/136 |
| 5,423,445 | A * | 6/1995 | Montanari et al. | 220/23.83 |
| 5,511,345 | A | 4/1996 | Jones et al. | |
| 6,729,490 | B2 * | 5/2004 | Bylo | 220/23.88 |
| 7,458,138 | B2 * | 12/2008 | Spiers et al. | 27/29 |
| 7,908,800 | B2 * | 3/2011 | Bach Lahor | 52/142 |
| 8,006,355 | B1 * | 8/2011 | Bobbitt | 27/30 |

FOREIGN PATENT DOCUMENTS

| | | | |
|---|---|---|---|
| EP | 1783303 | A1 | 5/2007 |
| FR | 2663667 | A1 | 12/1991 |
| IL | 161271 | B | 11/2009 |

* cited by examiner

*Primary Examiner* — Jeanette E Chapman
*Assistant Examiner* — Daniel Kenny
(74) *Attorney, Agent, or Firm* — patenttm.us

(57) ABSTRACT

An interment system (110) comprises a container arrangement (109) configured to hold the posthumous remains of a plurality of individuals arranged one above the other. The container arrangement defines a posthumous remains receiving chamber (156) in which the remains of the plurality of individuals can be held. The container arrangement (109) may comprise an outer interment container (112) and an inner interment container (150) which can be received within the outer interment container. The inner interment container (150) defines the aforesaid chamber (156).

21 Claims, 48 Drawing Sheets

FIG 40
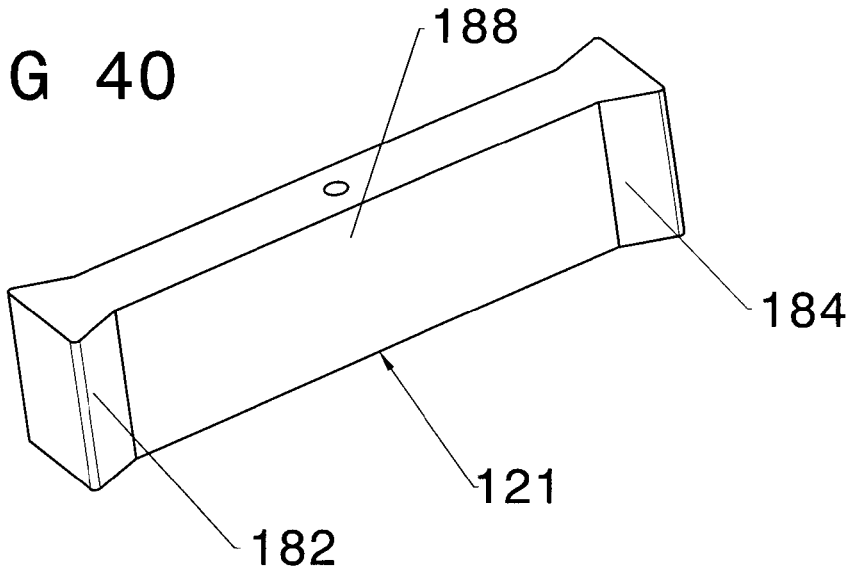
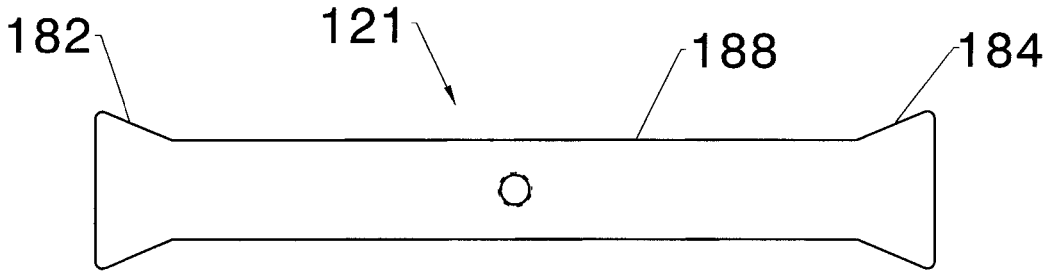
FIG 41

INTERMENT SYSTEM

This application claims priority of U.S. provisional application Ser. No. 61/354,828 filed 15 Jun. 2010. This application also claims priority from: U.K. patent application No. 1009771.5 filed 11 Jun. 2010, U.K. patent application No. 1009994.3 filed 15 Jun. 2010, and UK patent application No. 1109768.0 filed 10 Jun. 2011.

This invention relates to container systems. More particularly, but not exclusively, this invention relates to interment systems. More particularly, but not exclusively, this invention relates to interment systems for interring a plurality of the remains of the deceased.

There are several problems associated with excavating graves. Side walls can collapse during digging, during interment, or even with the bereaved present. In addition, there can be a build up of water in the grave, which might be difficult to remove. This can result in the coffin being laid in the water during the funeral.

According to one aspect of this invention, there is provided a container system comprising a container defining a space to receive at least one item, and a cooperating arrangement on the container, the cooperating arrangement being configured to cooperate with an article.

According to another aspect of this invention, there is provided an interment system comprising a container defining a space to receive posthumous remains, and a cooperating arrangement on the container, the cooperating arrangement being configured to cooperate with an article.

The container may comprise an interment container. The container may receive at least one coffin, in which the posthumous remains are held. The article may comprise an adjacent further container. The further container may comprise a further interment container.

The container may comprise a body having an upstanding wall arrangement. The body may include a base. The cooperating arrangement may be provided on the upstanding wall arrangement. The cooperating arrangement may be provided on the base. The upstanding wall arrangement may comprise side walls and front and rear walls. The cooperating arrangement may extend along the wall arrangement. Desirably, the cooperating arrangement extends upwardly along the upstanding wall arrangement. The cooperating arrangement may extend along the base.

The system may comprise a locating arrangement to locate the container. The locating arrangement may include a main locating member, which may be upright. The locating arrangement may be integral with the container. Alternatively, the locating arrangement may be separate from the container. The locating arrangement may include a stabilising member extending from the locating member. The stabilising member may extend transverse from the locating member. The stabilising member may extend from a lower end region of the locating member. The stabilising member may extend in opposite directions on the locating member.

The cooperating arrangement may include a first cooperating formation, which may cooperate with the locating member. The cooperating arrangement may comprise a plurality of first cooperating formations. The cooperating arrangement may include a second cooperating formation, which may cooperate with the stabilising member. The cooperating arrangement may comprise a plurality of second cooperating formations. The, or each, second cooperating formation may extend transverse to the, or each respective, first cooperating formation. The, or each, first cooperating formation may extend along the side wall of the container. The, or each, first cooperating formation may extend upwardly along the side wall. The, or each, second cooperating formation may extend along the base of the container.

The first cooperating formation may comprise an elongate first recess defined in the side wall, the first recess being configured to receive the locating member. The plurality of first cooperating formations may comprise a plurality of elongate first recesses extending along the side wall, each first recess being configured to receive a respective locating member. The first recess may have a dovetail profile. The second cooperating formation may comprise an elongate second recess defined in the base, the second recess being configured to receive the stabilising member. The plurality of second cooperating formations may comprise a plurality of second recesses extending across the base, each second recess being configured to receive a respective stabilising member.

The, or each, second recess may be configured to receive a lifting member of a lifting apparatus, such as a fork of a fork lift truck. The, or each, second recess provides the advantages in the embodiments described herein that they allow the coffin to be raised away from the ground, they facilitate drainage of the ground, and strengthen the container.

The, or each, stabilising member may have a profile that is generally in the form of an isosceles trapezium. The, or each, second cooperating formation may have a corresponding profile to the respective stabilising member.

The system may comprise a plurality of locating arrangements. The system may comprise a plurality of the containers, which may be arrangeable adjacent one another. At least one locating arrangement may be disposed between the adjacent containers, and may cooperatively engage the two adjacent containers. The locating member may comprise a main portion and an engagement portion on the main portion, the engagement portion being configured to cooperate with the first cooperating formation on the container. The engagement portion may have a profile that is generally in the form of an isosceles trapezium. Desirably, the engagement portion has a profile that is generally dovetail shaped. The engagement portion may be configured to cooperate with the first cooperating formation on the container.

The locating member may comprise two engagement portions on the main portion to cooperate with respective first cooperating formations on adjacent containers. The two engagement portions may be arranged opposite each other on the main portion. The engagement portions may extend substantially the length of the main portion.

The interment arrangement may include an inner container which can be disposed within the container. The inner container may be substantially fully receivable within the container. This feature provides the advantage in one embodiment that it facilitates removal of the remains interred therein by allowing the inner container to be removed, rather than the container.

The upstanding wall of the container may comprise one or two skins. The inner container may comprise an upstanding wall arrangement. The wall arrangement may comprise one or two skins. The inner container may comprise a base.

The container may include a plurality of footings to allow a person to exit the container. The footings may be integral with the container, and may be moulded therewith. Alternatively, the footings may be formed separately and mounted on the container.

The system may include a holding arrangement for holding at least one item, such as a headstone or a plinth, adjacent the container. The holding arrangement may include anchoring formations to anchor the, or each, item. The holding arrangement may comprise a main part, which may be of substantially the same height as the container. The holding arrangement may further include holding members to hold the item. The holding members may comprise projections extending upwardly from the main part. Each holding arrangement may comprise a pair of projections on the main part. A plurality, for example two or three, holding arrangements may be provided at each container. The projections on the, or each, holding arrangement may be spaced from each other by substantially the width of the item.

An anchor system may be provided to anchor the item. The anchor system may cooperate with the holding arrangement and may be received between the holding members. The anchor system may comprise a stabilising arrangement to stabilise the item. The stabilising arrangement may comprise an anchor member, which may have a generally U-shaped profile to receive a weighting means. The weighting means may comprise concrete or other suitable curable material. The anchor system may further include reinforcement on the anchor member to reinforce the weighting means. The reinforcement may comprise a plurality of rebars extending across the anchor member. The anchor system may include fixing means to fix the item to the anchor system. The fixing means may comprise first fixing formation to cooperate with a second fixing formation on the item.

The first fixing formation may comprise one of a tube and an insertion member for insertion into the tube. The second fixing formation may comprise the other of the tube and the insertion member. In one embodiment, the fixing means comprises a plurality of tubes to cooperate with a plurality of insertion members on the item.

The anchor member may have open opposite ends and, where the anchor system is to be used with a single container, a containment means may be provided to contain the weighting means. The containment means may be formed of a plastics material.

A joining member may be provided to join a first anchor member to a second anchor member. The joining member may be used in situations where a plurality of containers are arranged side by side, and the anchor system extends from one container to a container adjacent thereto. The joining member may be generally U-shaped. Weighting means, such as concrete, may be provided on the joining member to join the reinforcement of one anchor member to the reinforcement of an adjacent anchor member. Joining formations, which may comprise tubes, may be provided on the joining member to join the reinforcement of one anchor member to the reinforcement of an adjacent anchor member.

The system may comprise securing means to secure one or more items, such as railings or handles, to the container. The securing means may comprise threaded members, which may be internally threaded. Alternatively, the securing means may comprise clips. The securing means may be provided on the container.

The container, the holding arrangement and the locating arrangement may be arranged in a desired one of a plurality of configurations to suit the appropriate requirements of the grave site.

The system may include drainage means to allow drainage, such as from the ground surrounding the container. The drainage means may comprise a conduit extending from the container. The conduit may be arranged in fluid communication with the ground surrounding the container.

The system may comprise a spacing arrangement which can be arranged in the container to space the coffins from one another therein. The spacing arrangement may comprise a generally planar support platform and load bearing members to bear a load on the support platform. A plurality of spacing arrangements may be disposed in the container, and may be arranged one upon another to space a plurality of the coffins. At least one of the coffins may be arranged on the spacing. The load bearing members of one spacing arrangement may be disposed on the platform member of the spacing arrangement below. The, or each, platform member may be arranged over a respective coffin. The platform member may support a respective coffin. The provision of the spacing arrangement has the advantage in the embodiment described herein that it can prevent damage to a coffin, for example during exhumation, and can provide additional mechanical support to the container.

According to another aspect of this invention, there is provided an interment system comprising an outer interment container and an inner interment container received within the outer interment container, the inner container being configured to receive the posthumous remains of at least one individual. The aforesaid posthumous remains may be within a coffin or casket.

The inner and outer interment containers may, in combination, constitute a container arrangement. The container arrangement may include a base to support the posthumous remains of the, or each, individual. The inner interment container may be formed as a one piece unit, for example by moulding. The outer interment container may be formed as a one piece unit, for example by moulding.

The inner interment container may be configured to receive the posthumous remains of a plurality of individuals. The inner interment container may have a depth to allow the posthumous remains to be arranged above one another in the inner interment container.

The interment system may comprise a spacing arrangement to space the posthumous remains of the individual from the base of the inner interment container. The interment system may comprise a plurality of spacing arrangements which can be stacked upon one another to space the posthumous remains of a plurality of individuals from the base of the inner interment container and from each other. Each spacing arrangement may be provided to support the posthumous remains of a respective individual. The, or each, spacing arrangement may have a support platform to support the remains. Each support platform may comprise a planar member and may include a plurality of raised members. The raised members may be elongate and may extend across the platform the raised members may comprise ribs.

The, or each, spacing arrangement may further include a plurality of elongate load bearing members extending downwardly from the support platform. The load bearing members may be arranged to engage the base of the inner interment container or an adjacent support platform below. Each elongate load bearing member may comprise a load bearing leg. The, or each, spacing arrangement may comprise six load bearing members.

The interment system may include a connecting arrangement to connect the container arrangement to a further container arrangement. The connecting arrangement may comprise a plurality of connecting members, each connecting member having a co-operating formation to co-operate with the container arrangements. Each connecting member may have first and second co-operating formations to co-operate respectively with the co-operating arrangements on first and second container arrangements.

The interment system may comprise a plurality of first connecting arrangements to connect first and second container arrangements to each other in a first orientation, and a plurality of second connecting arrangements to connect first and second container arrangements to each other in a second orientation. Each of the first and second connecting arrangements may comprise two co-operating formations. The second co-operating arrangement may comprise an extension member extending between the two co-operating formations. The extension member may be elongate. Each co-operating formation may comprise a dovetail member.

The container arrangement may include a co-operating arrangement to co-operate with the co-operating formations on the connecting member. The co-operating arrangement and the co-operating formations may comprise dovetail formations. The dovetail formations may comprise dovetail members and dovetail recesses, wherein the dovetail recesses can receive the dovetail members. The connecting member may include the dovetail members. The co-operating arrangement on the container arrangement may define the dovetail recesses.

Where the container arrangement comprises inner and outer interment containers, the connecting arrangement may be configured to connect the outer interment container of a first container arrangement to the outer interment container of the second container arrangement.

The outer interment container may include the co-operating arrangement, as described above.

The outer interment container may comprise outer wall members defining a container receiving space to receive the inner interment container. The outer interment container may include an inwardly extending flange member extending inwardly from an upper region of the wall members over the container receiving space. The co-operating arrangements may be provided by the outer wall members.

The inner interment container may comprise inner wall members, defining a posthumous remains receiving chamber to receive the posthumous remains. The inner interment container may include an outwardly extending lip portion on an upper region of the inner wall members. The outwardly extending lip portion may be provided to engage over the flange member when the inner interment container is received by the outer interment container.

The outer interment container may have an outer base from which the outer wall members extend. The outer base may comprise a generally planar outer base portion and may include downwardly extending foot members on the outer base portion. The inner interment container may have an inner base arrangement from which the inner wall members may extend. The inner base arrangement may engage the outer base arrangement when the inner interment container is received by the outer interment container.

The inner base arrangement may include a generally planar inner portion and a plurality of foot members extending downwardly from the planar inner portion. The foot member may engage the outer base arrangement when the inner interment container is received by the outer interment container. The inner base arrangement may include raised members to support the remains, or the lower most remains in the inner interment container. The raised member may be provided on the inner planar portion. The raised members may be elongate and may extend across the inner planar portion. The raised members may comprise ribs.

The interment system may include a lid arrangement for installation on the container arrangement. The lid arrangement may include an insertion member for insertion into the inner interment container. The lid arrangement may further include an outwardly extending engagement portion to engage the outer interment container. The engagement portion may extend across the outer interment container. The engagement portion may include co-operating formations to co-operate with the co-operating arrangement of the outer interment container. The co-operating formations may have a dovetail configuration.

The insertion member may define a recess to receive earth, soil or other matter when the lid arrangement is installed on the container arrangement. If desired, the remains of an individual may be disposed in the recess. The insertion member may include hand grips extending into the recess. The hand grips may be provided to allow the lid arrangement to be manipulated.

The insertion member may comprise a bottom member and upright wall members. In one embodiment, the upstanding wall members may extend from the bottom member. In another embodiment, the insertion member may comprise a bottom arrangement and upright wall members. The bottom arrangement may be received in a space defined by the upright wall members. The bottom arrangement may be telescopically movable relative to the wall members. The bottom arrangement may comprise a bottom member, and upright side members extending from the bottom member. The upright side members may be received in the space defined by the wall members.

The interment system may further include an anchor system for holding further articles, such as grave stones or the like. The anchor system may be configured to hold suitable securing material, such as concrete. The anchor system may comprise a holding member, which may have a generally 'U' shaped profile. The holding member may define a recess for receiving mounting member of an article, such as a grave stone.

The anchor system may include a mounting device for mounting a grave stone on the anchor system. The mounting device may comprise a plurality of struts. The mounting device may include a guide member, which can be held by the struts. In one embodiment, the guide member may extend through the struts. The guide member may be elongate and may define a bore to receive a tine on a grave stone.

The mounting device may include two of the aforesaid guide members, each extending through the struts. The mounting device may include opposed generally U shaped carrier member to carry the struts. The carrier member may include an attaching portion to attach the mounting device to the holding member. The attaching portion may comprise a hook portion.

The interment system may include a plurality of path forming members, which may be arranged between adjacent rows of container arrangement. In such a situation, the path forming members may hold concrete or other suitable path forming material to form a path between the rows of the interment systems. Each path forming member may be generally U shaped.

The interment system may comprise a lifting member to lift a securing material from the lid arrangement. The lifting member may comprise support means and a spacer member having a cooperating part. The cooperating part may comprise a receiving member. The spacer member may be elongate and the cooperating part may be disposed at one end of the spacer member. The cooperating part may be configured to cooperate with a lifting element, such as a hook mounted on a crane. The receiving member may define an aperture to receive the lifting element.

The support means may comprise a plurality of carrying members, which may extend radially from a central region. The spacer member may extend upwardly from the central region.

In one embodiment, the inner interment container may be collapsible. In this embodiment, the inner interment container may comprise a plurality of U shaped elements. Each U shaped element may comprise an elongate base element and two upstanding elements, which may extend upwardly from the opposite ends of the base element. The U shaped elements maybe connected to one another by foldable connecting means, which may be attached to the respective upstanding elements. Each connecting means may comprise first and second connecting elements, which may be foldably attached to each other, for example by a hinge. Each connecting means may be foldably attached to the, or each, adjacent connecting means by a second hinge. Each second hinge may be mounted on a respective one of the upstanding elements.

The interment system may include at least one infill member. The interment system may include a plurality of infill members. The, or each, infill member may be provided to fill the space between the spacing arrangement and the lid arrangement. Each infill member may comprise a casing and a lifting member in the casing. The casing may define an aperture to allow access to a lifting member to allow the infill member to be lifted into, and out of, the container arrangement.

The casing may comprise a main part and a pair of projections which extend from the main part on opposite sides thereof. The projections may extend centrally from said opposite sides of the main part. The projections may have a height which is less than the height of the main part. Each of the projections may define with the main part at least one recessed region. Two of said recessed regions may be defined above and below the projections.

The infill members may be formed to have suitable size and shape so that when the infill members are stacked within the container arrangement, such as in the inner interment container, the recessed regions can receive rungs provided in the container arrangement.

The main part may comprise upper and lower casing members. Each infill member may include a plurality of support members within the casing. The support members may extend between the upper and lower casing member. The support members may be provided to support either further infill members disposed thereon, or the lid arrangement. The main part may include side casing members. The lifting member may extend between the opposed side casing members. The lifting member may be attached to the opposed side casing members.

Embodiments of the invention will now be described by way of example only, with reference to the accompanying drawings, in which:

FIG. 40 is a perspective view of a further connecting member;

FIG. 41 is a top view of the further connecting member shown in FIG. 39 on a different scale;

Figure 1:
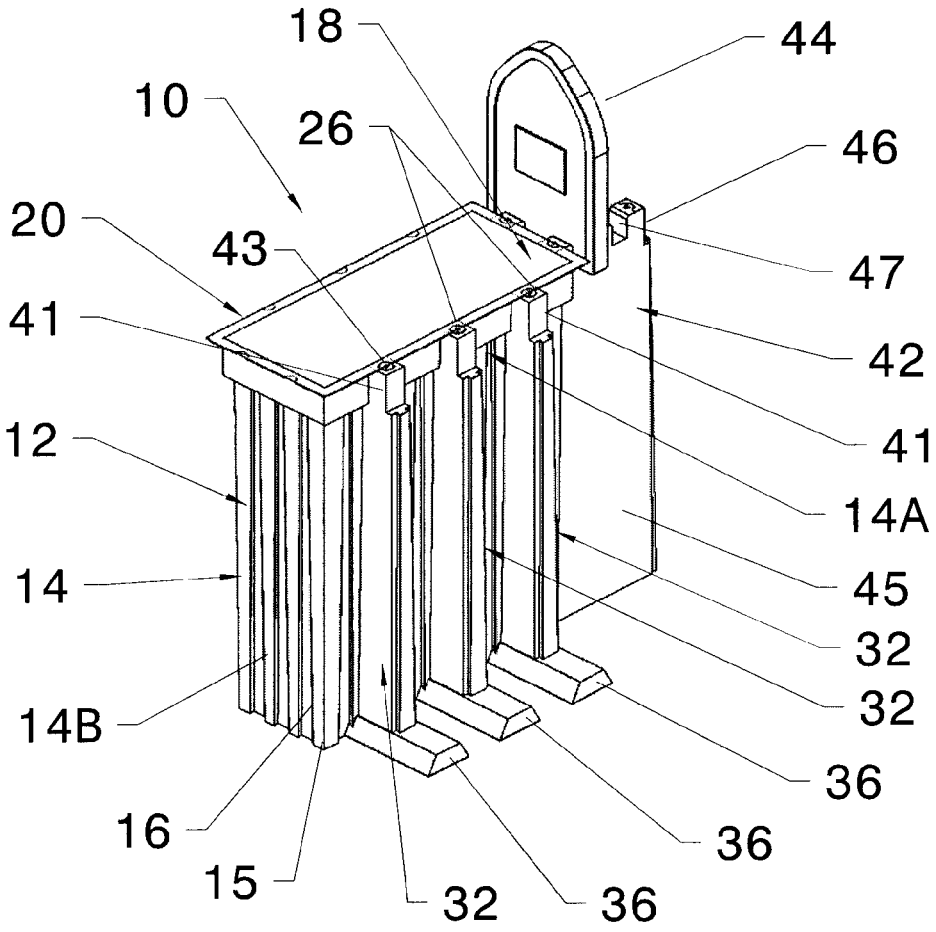
FIG. 1 is a perspective view of an embodiment of an interment system comprising a single interment container.

Referring to the drawings, FIG. 1 shows a container system in the form of an interment system 10 which comprises a container in the form of an interment container 12. The interment container 12 is intended to hold a plurality of coffins and be arranged within an excavation in the ground. The interment container 12 is of such a height that it can hold up to six coffins one above the other and therefore needs the ground to be excavated to a depth of several feet depth. The excavations can be of different widths, depending upon the size of the interment container used.

It will be appreciated that the interment container 12 can hold any other suitable number of coffins, such as four or five.

Figure 2:
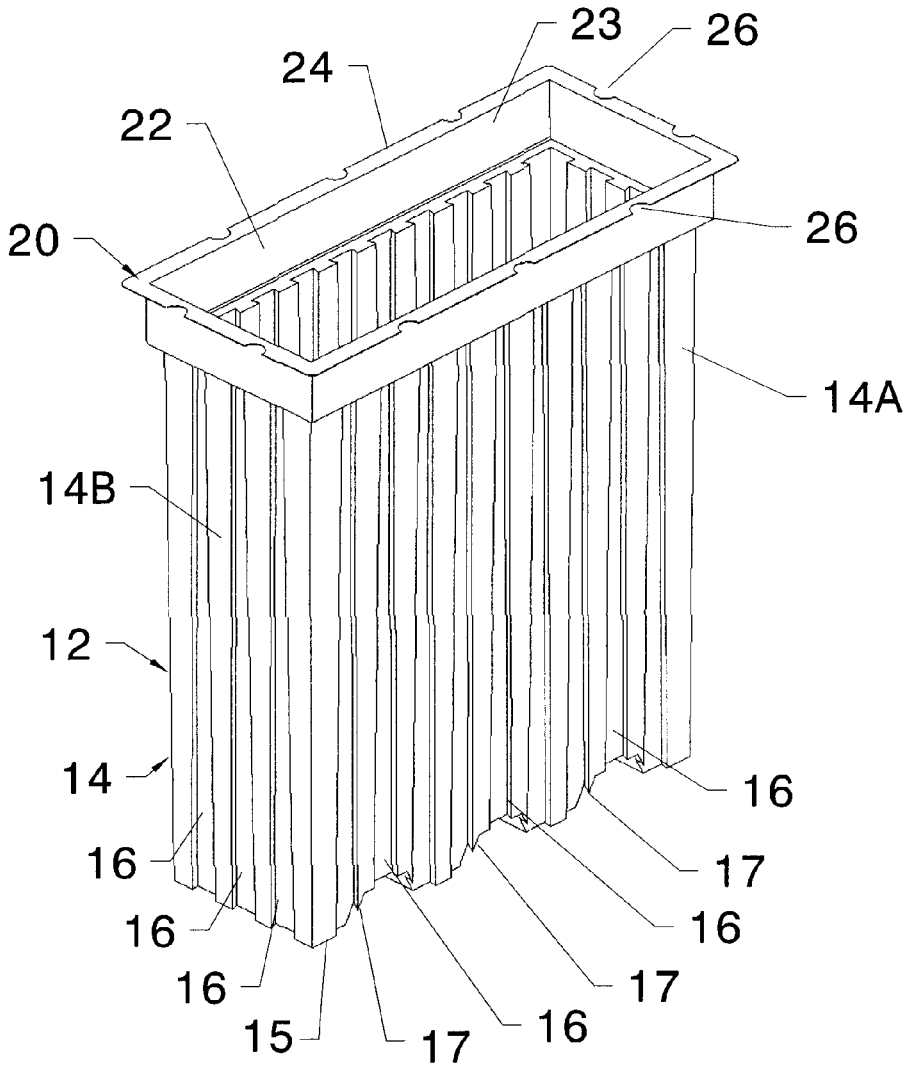
FIG. 2 is a perspective view of an embodiment of an interment container.

The interment container 12 comprises a body 14 having an upstanding wall arrangement comprising a pair of opposite side walls 14A, and opposite front and rear walls 14B. The body 14 also has a base 15. Referring to FIG. 2, each side wall 14A is provided with a plurality of first cooperating formations in form of elongate first recesses 16. The first recesses 16 are arranged one after the other around the side walls 14A and the front and rear walls 14B of the interment container 12. The first recesses extend substantially vertically lengthwise up the side walls 14A. The front and rear walls 14B are also provided with a plurality of the elongate first recesses 16, which also extend substantially vertically lengthwise up the front and rear walls 14B of the interment container 12.

Each first recess 16 is wider at the base 15, than at the top of the body 14, and therefore, tapers inwardly from the base 15 to the top of the body 14, for a purpose which is described below. The first recesses 16 have the advantage in the embodiments described herein of providing strength to the side walls 14A and to the front and rear walls 14B. The underside of the base 15 is provided with a plurality of second cooperating formations in the form of second recesses 17. The second recesses 17 extend across the width of the base 15.

In the embodiment shown, the interment apparatus 10 further includes a cover 18 mounted on the open top region of the interment container 12. It will be appreciated that, in some embodiments, the cover can be omitted.

The interment container 12 shown in FIG. 2 has an upper rim arrangement 20 provided on the body 14. The rim arrangement 20 comprises a rim portion 22 extending upwardly from the body 14. The rim portion 22 defines an open top 23 of the interment container 12. The rim portion 22 extends from the body 14 to a horizontal flange 24, which may define a plurality of indentations 26. In FIG. 2, the indentations 26 are shown as being semicircular, but it will be appreciated that the indentations 26 could be of any other suitable shape, such as rectangular.

Figure 3:
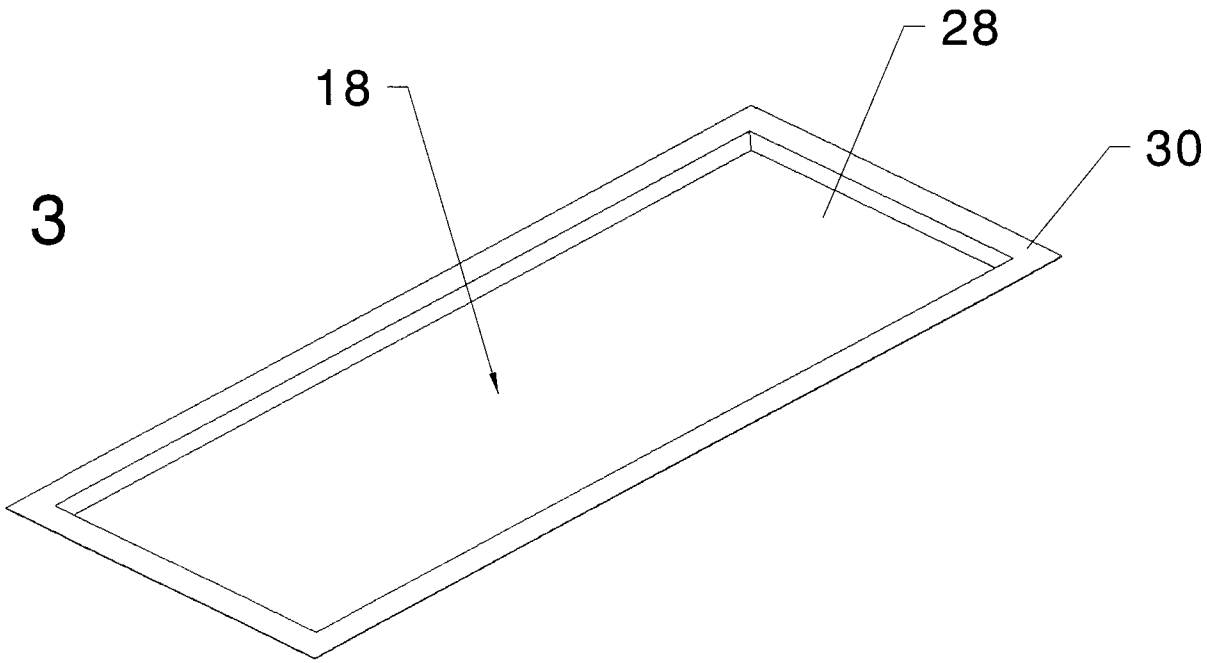
FIG. 3 is a perspective view of a cover for the interment container shown in FIG. 2.

The cover 18 is shown in more detail in FIG. 3 and comprises a concave seating portion 28 and a lip portion 30. The lip portion 30 engages the flange portion 24 and the seating portion 28 is received within the open top 23 of the interment container 12. In another embodiment (not shown), the seating portion may be convex, and may extend to an apex. This embodiment has the advantage that rainwater runs off the cover 18, and is not collected thereby.

Figure 4B:
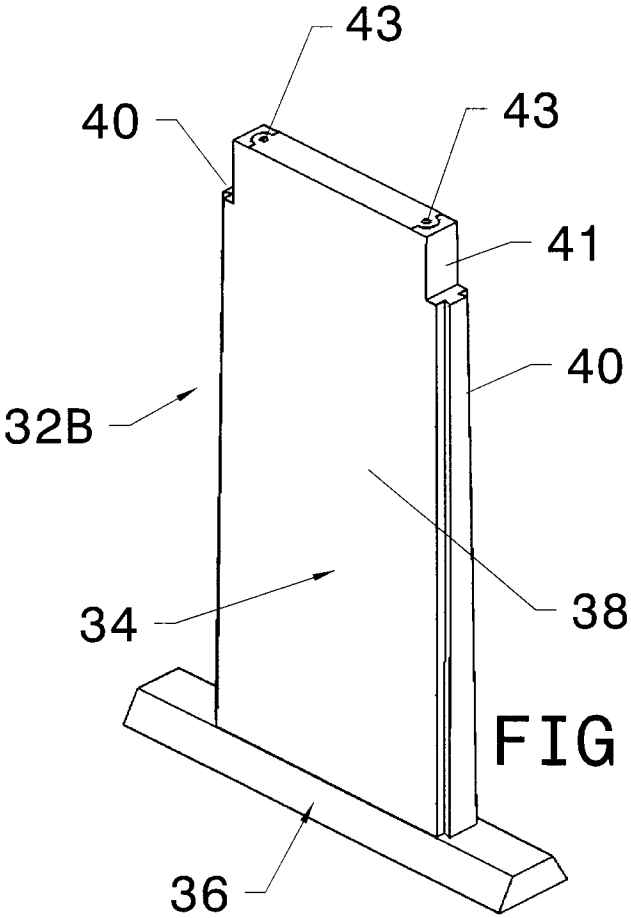
FIG. 4B is a perspective view of a locating arrangement of a second size for use in the interment system shown in FIG. 1.
Figure 4A:
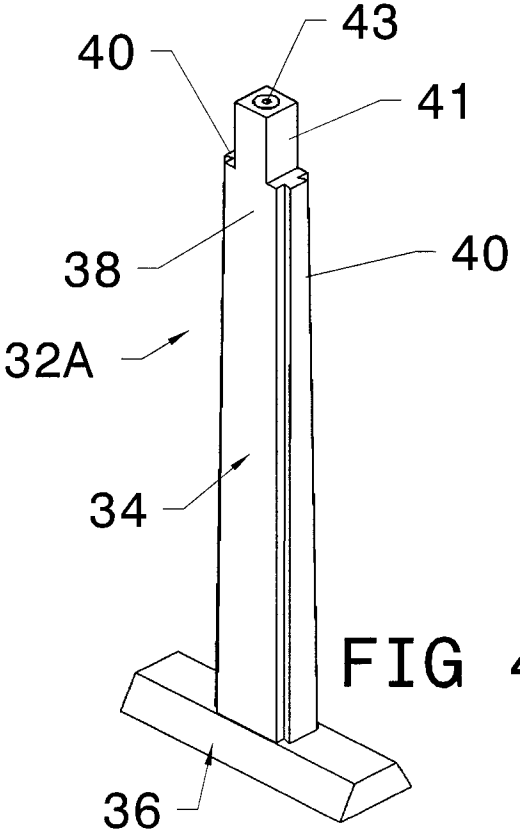
FIG. 4A is a perspective view of a locating arrangement of a first size for use in the interment system shown in FIG. 1.

The interment system 10 further includes a plurality of locating arrangements 32A and 32B for locating the interment container 12. FIG. 4A shows a first locating arrangement 32A of a first size, which spaces adjacent interment containers 12 from each other by a first distance. FIG. 4B shows a second locating arrangement 32B which spaces adjacent interment containers 12 from each other by a second distance, the second distance being greater than the first distance. The appropriate locating arrangement 32A or 32B is selected depending upon the requirements at the burial site.

Each of the locating arrangements 32A, 32B comprises an upright main locating member 34 and a stabilising member 36 provided at the lower end of the locating member 34. The stabilising member 36 extends outwardly from the locating member 34 on opposite sides thereof, and can be received by one of the second recesses 17 defined in the bases 15 of the adjacent interment containers 12. The locating member 34 comprises a main portion 38 and two elongate first engagement portions 40 arranged opposite each other on the main portion 38. The elongate engagement portions 40 are of a dovetail profile and can be received in cooperating elongate first recesses 16 in the side walls 14A. The two first engagement portions 40 are arranged on opposite sides of the main portion 38. The locating arrangements 32A, 32B further include an upwardly projecting member 41 on the main portion 38. The upwardly projecting member 41 has at least one securing means in the form of an internally threaded member 43, which lies flush with a top face thereof.

Referring back to FIGS. 1 and 2, the semi-circular recesses 26 in the flange 24 allow access to the internally threaded members 43 when the locating arrangements 32A or 32B are cooperatively engaged with the interment container 12. The main portion 38 of the first locating arrangement 32A has a width A that is larger and the width B of the main portion 38 of the second locating arrangement 32B. Therefore, when the first locating arrangement 32A is used, the interment containers 12 are spaced closer to each other than when the second locating arrangement 32B is used.

Figure 5:
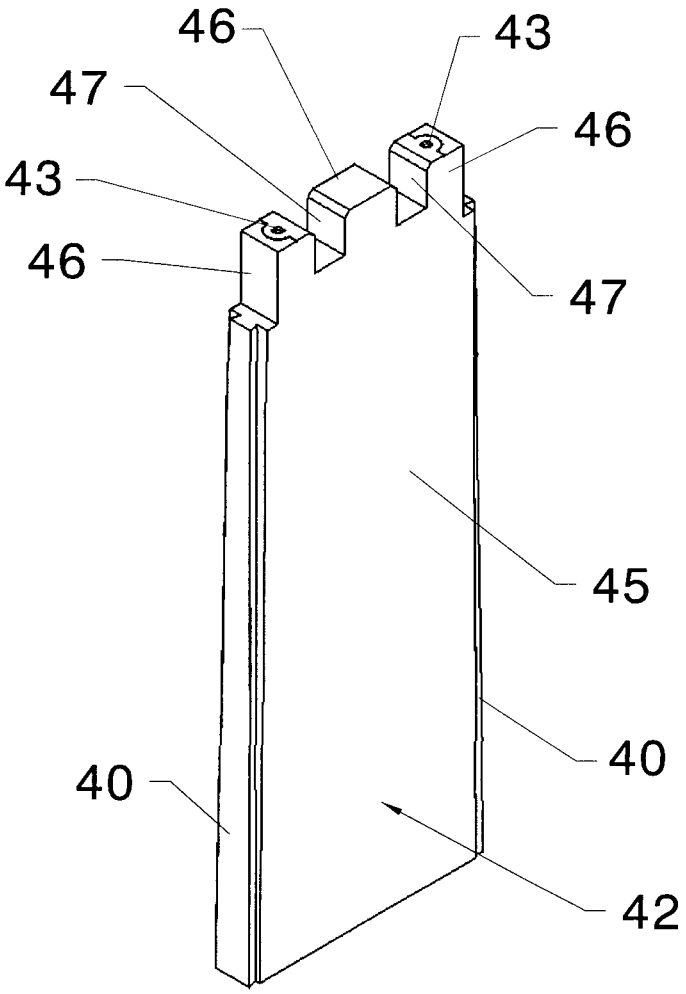
FIG. 5 is a perspective view of a holding arrangement for use in the interment system shown in FIG. 1.

The interment system 10 may include a holding arrangement 42 which can be used to hold an item, for example a headstone 44. The holding arrangement 42 is shown more clearly in FIG. 5 and is of substantially the same height as the interment container 12. The holding arrangement 42 includes a main member 45 and upwardly extending projecting members 46 on the upper surface of the main member 45. The projecting members 46 define recesses 47 therebetween. The holding arrangement 42 further includes an elongate engagement portion 40 on the opposite end faces of the main member 45. The engagement portions 40 can cooperate with the dovetail profiled recesses 16 in the rear wall 14B. The engagement portions 40 on the main member are substantially the same as the engagement portions 40 on the main portion 38 of the locating arrangements 32A and 32B.

A plurality of the holding arrangements 42 are mounted on the rear wall 14B of the interment container 12 by means of the engagement portions 40. In the embodiment shown, there are three holding arrangements 42 mounted on the rear wall 14B. With this arrangement, the recesses 47 of the three holding arrangements 42 are aligned with one another and the headstone 44 is received in one set of the aligned recesses 47.

A securing means, in the form of the internally threaded members 43 are provided in the top face of the projecting members 46, and lie flush with the top face thereof.

The internally threaded members 43 in the locating arrangements 32A or 32B and the holding arrangements 42 are configured to secure one or more items to the interment system 10, after the interment system has been installed in the excavation. The items may be in the form of railings, in order to prevent attendees at a funeral from falling into the grave, or plant pots after a funeral. The internally threaded members 43 can also be used to install the locating arrangements 32, by screwing lifting devices into the internally threaded members 43. The locating arrangements 32A or 32B can then be lifted by the use of suitable lifting apparatus, such as a crane, and then lowering the locating arrangements at appropriate spaced intervals into the excavation.

Figure 6:
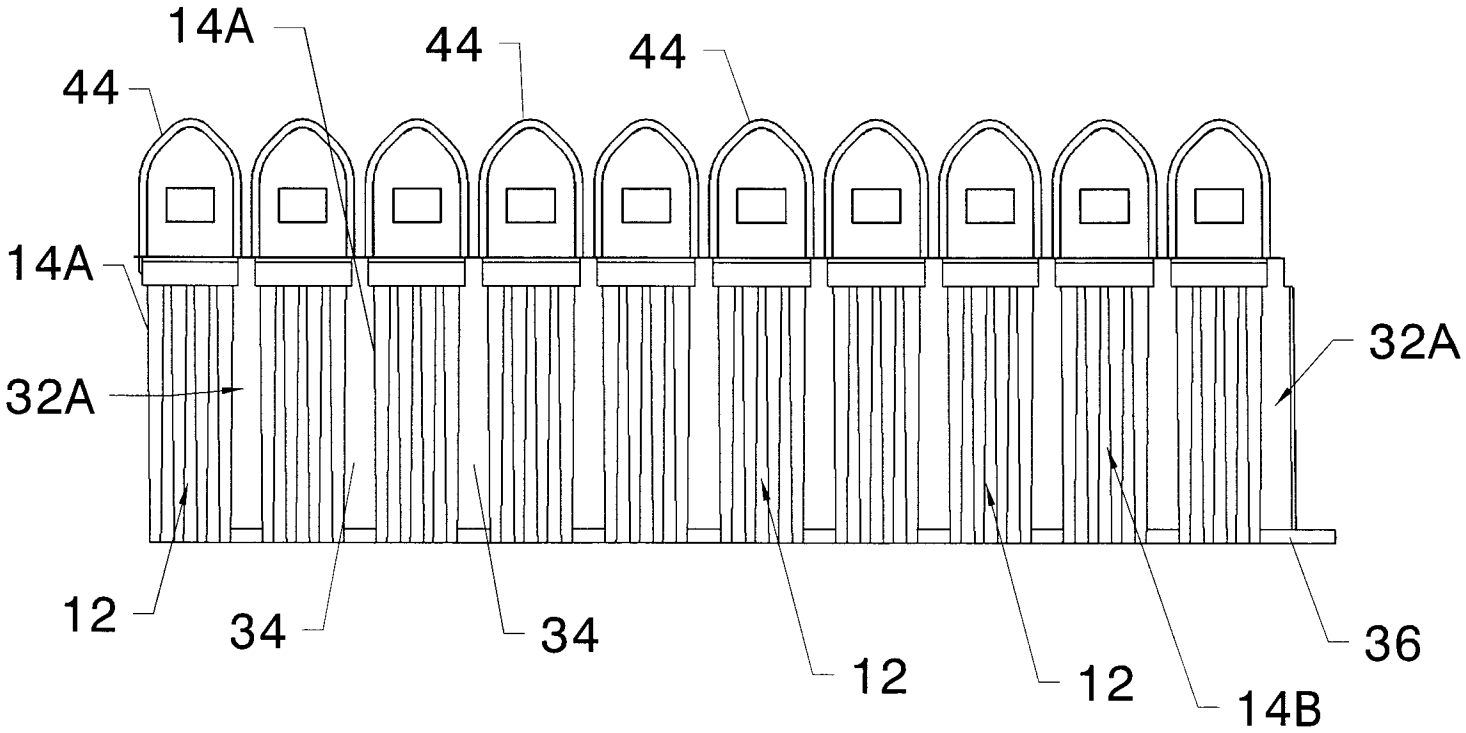
FIG. 6 is a front view of an embodiment of an interment system comprising a plurality of interment containers.
Figure 7:
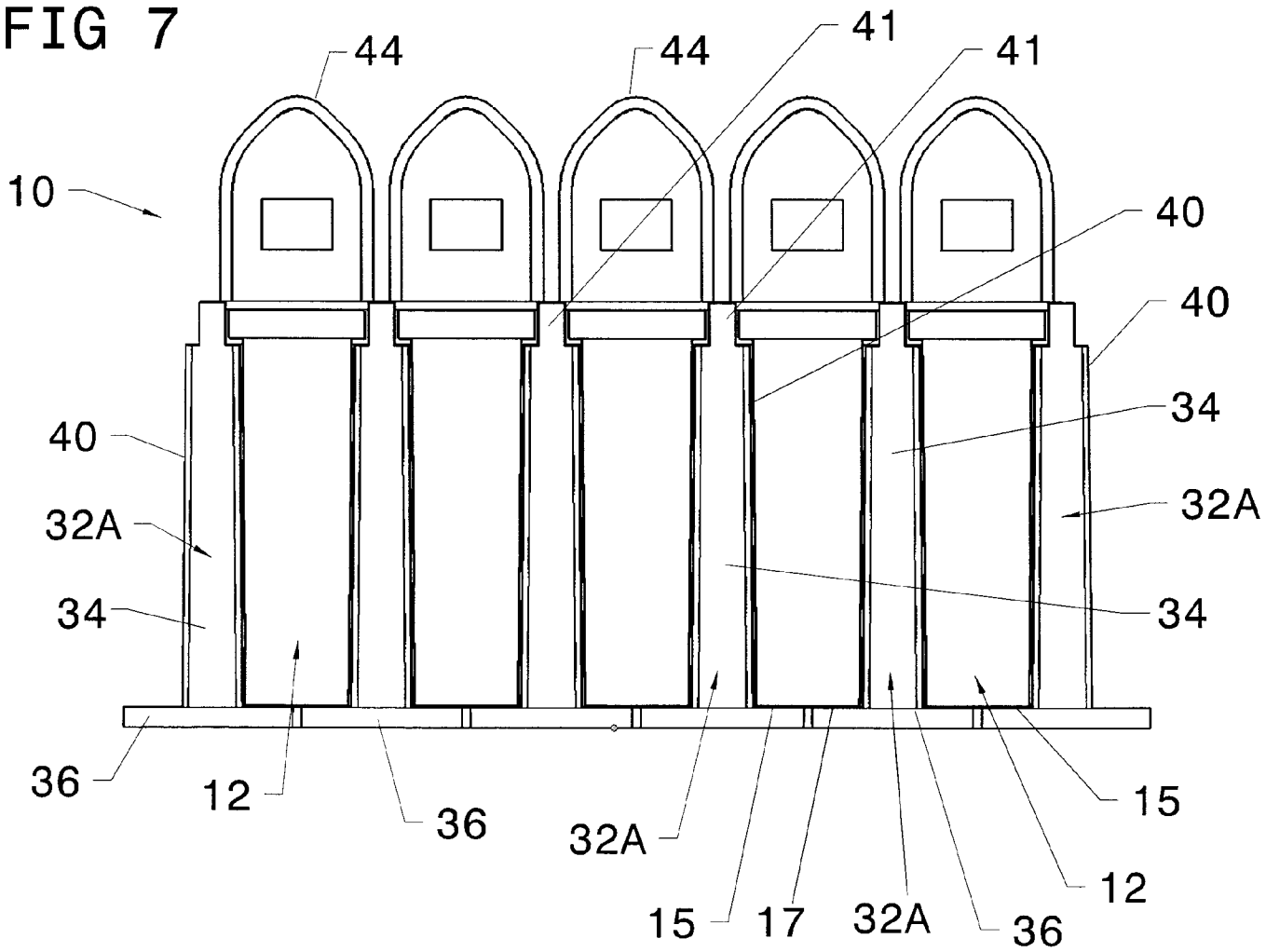
FIG. 7 is a front sectional view of an interment system similar to the interment system shown in FIG. 6 but comprising five interment containers.

Referring to FIGS. 6 and 7, one embodiment of the interment system 10 may comprise a plurality of interment containers 12 arranged side by side. The adjacent interment containers 12 are held in place by the provision of respective locating arrangements 32A therebetween. Each of the interment containers 12 is seated on the stabilising member 36 on each of the respective locating members 34. In addition, the first recesses 16 in the side walls 14A of adjacent interment containers 12 receive the engagement portions 40 on the locating members 34 arranged therebetween. The corresponding dovetail configuration of the first recesses 16 and the engagement portions 40 locates the adjacent interment containers 12 in position next to each other, and holds them in place.

Figure 9:
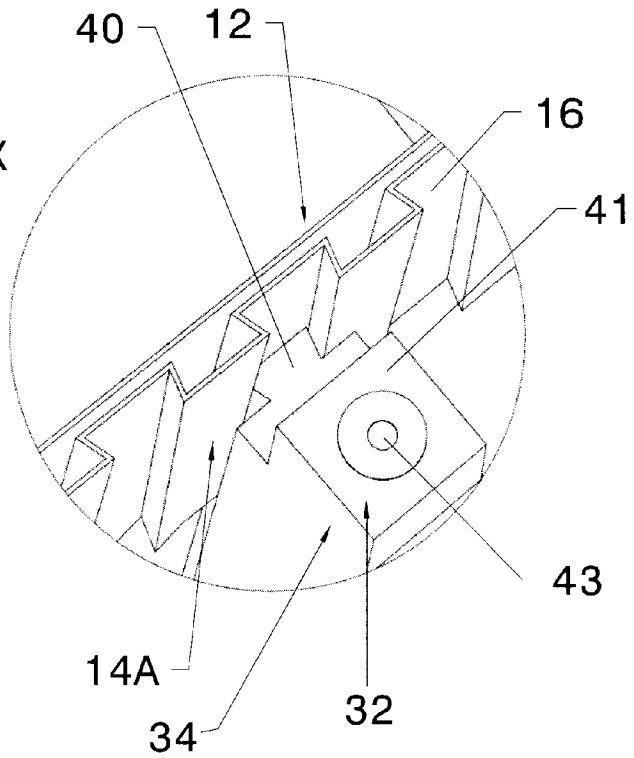
FIG. 9 is a close up of the region marked IX in FIG. 8.
Figure 8:
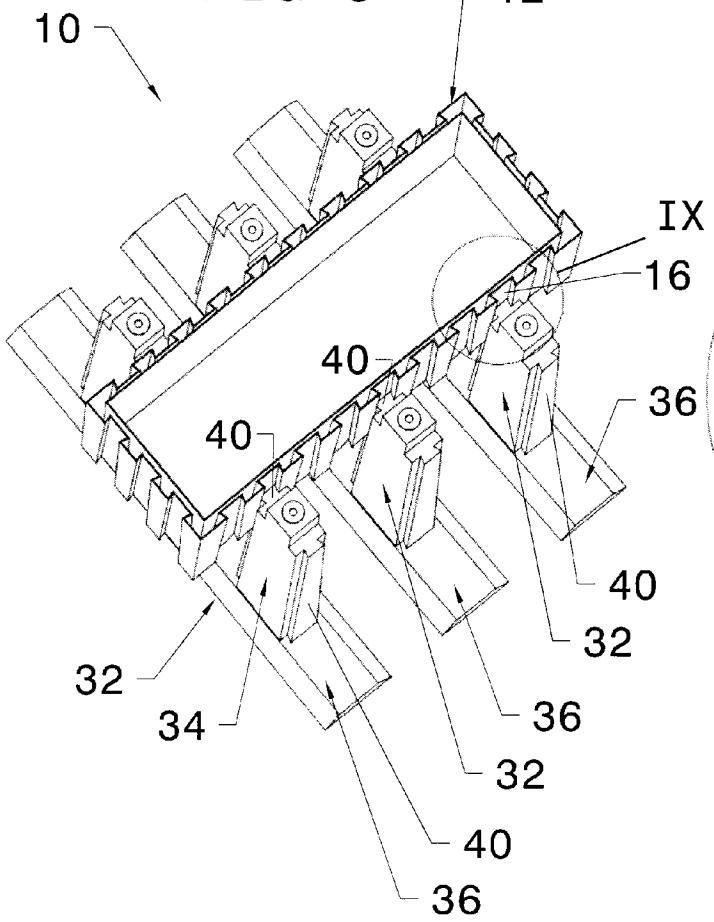
FIG. 8 is a top view showing the interment container shown in FIG. 1 and a plurality of locating arrangements.

As shown in FIG. 6, an array of more than six interment containers 12 is arranged in a trench, with the locating arrangements 32A or 32B, as described above, provided between the adjacent interment containers 12. FIG. 7 shows an array of four interment containers 12. It will be appreciated that the array of interment containers 12 can comprise any suitable number of interment containers 12. FIGS. 8 and 9 show the cooperation between the engagement portions 40 on the locating arrangement 32A or 32B and the elongate dovetail profiled recesses 16 defined in the sidewalls 14A of the interment container 12.

As can be seen from FIG. 9, the engagement portion 40 has a dovetail profile when viewed from one end, and the first recess 16 has a corresponding dovetail profile. Thus, the interment container 12 can be slid onto the locating arrangement 32, with the engagement portions 40 being slidably received in the first recess 16, thereby securing the locating arrangement 32A or 32B and the interment container 12 to each other. In the embodiment shown in FIG. 9, the elongate first recesses 16 and the engagement portions 40 have a draft angle to minimise friction between the interment container 12 and the locating arrangement 32A or 32B.

Figure 10:
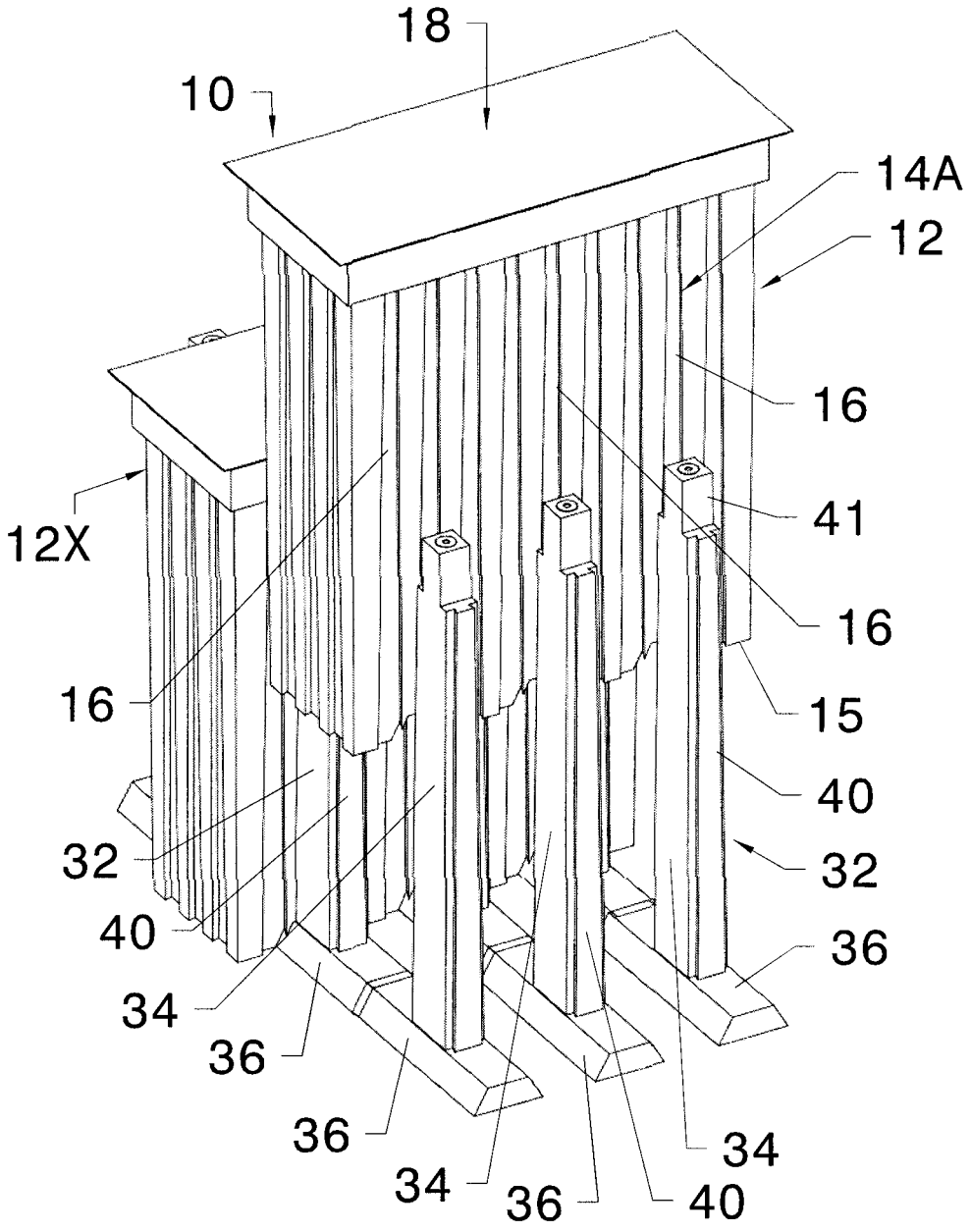
FIG. 10 shows the interment container shown in FIG. 1, being lowered into position adjacent another container

FIG. 10 shows an interment container 12 being lowered into position adjacent a further interment container 12X. When the interment container 12 is lowered into its position adjacent the further interment container 12X, the elongate engagement portions 40 on the locating arrangements 32A or 32B are received in the elongate first recesses 16 in the side wall 14A on the interment container 12. When the interment container 12 is fully lowered, the stabilising members 36 are received in the second recesses 17 in the base 15.

Figure 11B:
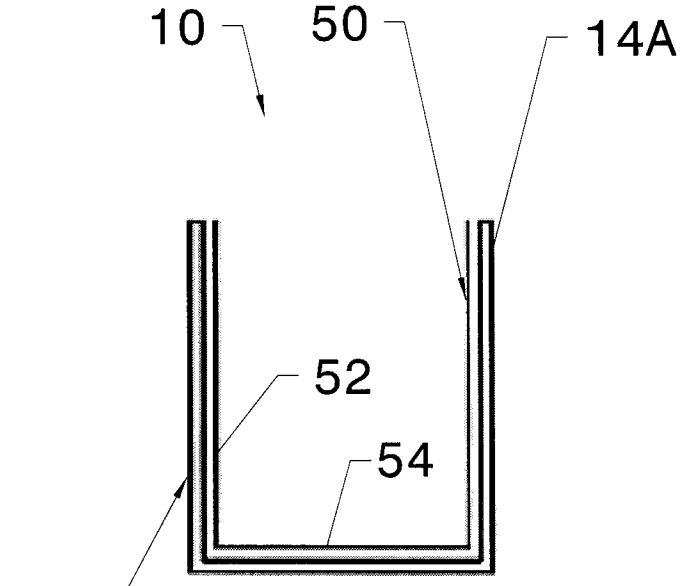
FIGS. 11A to 11D are diagrammatic views of different arrangements of interment containers with inner containers.
Figure 11A:
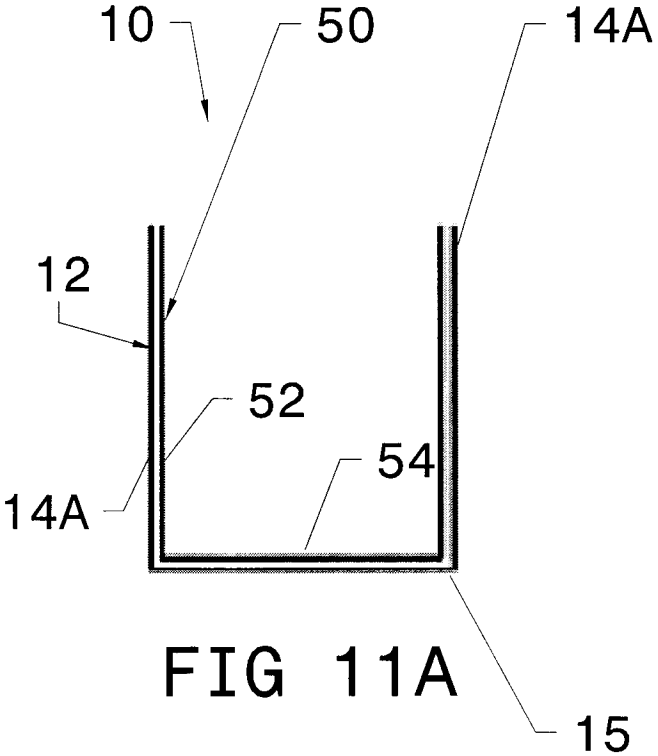
Figure 11D:
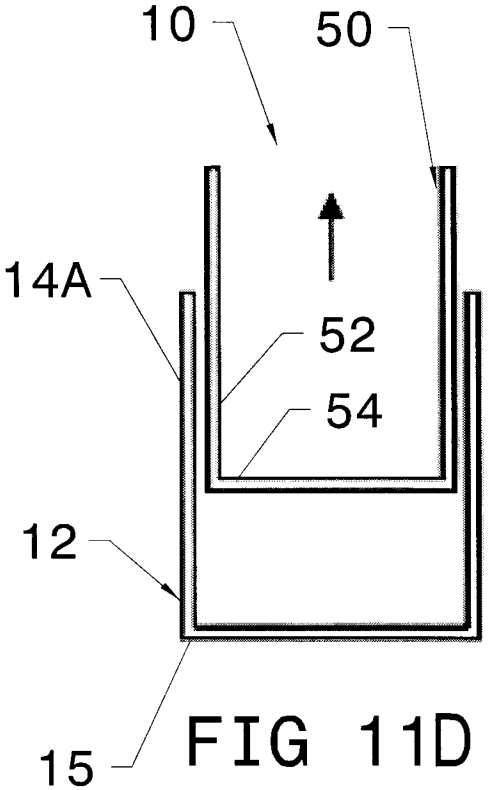

FIGS. 11A to 11D and 5 show another embodiment, in which the interment system 10 comprises container arrangement comprising an interment container 12 as described above, and an inner container 50 arranged within the interment container 12. The inner container is of generally the same height as the interment container 12. With this embodiment, the coffins are arranged within the inner container 50, which is, in turn, within the interment container 12. This embodiment provides the advantage that the coffins can easily be removed from the interment container 12, for example in the case of an exhumation, by simply lifting the inner container 50 from within the interment container 12, as shown in FIG. 11D, by simply lifting the inner container 50, including the contents thereof, from within the interment container 12. Thus the remains within the inner container 60 are not disturbed during exhumation. The interment container 12 is not removed, and is maintained within the excavation.

Figure 11C:
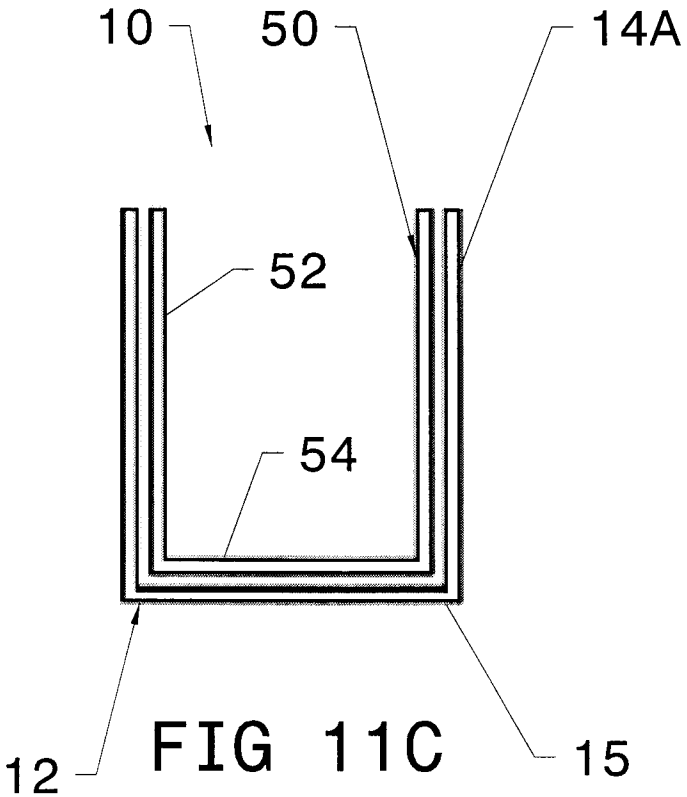

The inner container 50 has an upstanding wall arrangement 52 and a base 54, which can be formed of a single skin, as shown in FIGS. 11A and 11B, or a double skin, as shown in FIGS. 11C and 11D. FIGS. 11A to 11D show that the walls 14A, 14B and the base 15 of the interment container 12 can be formed of a single skin or a double skin.

Where the interment container 12 is used without an inner container 50, exhumation can be carried out by lifting the interment container 12 from the locating arrangements 32A or 32B with which the interment container 12 cooperates.

Figure 12:
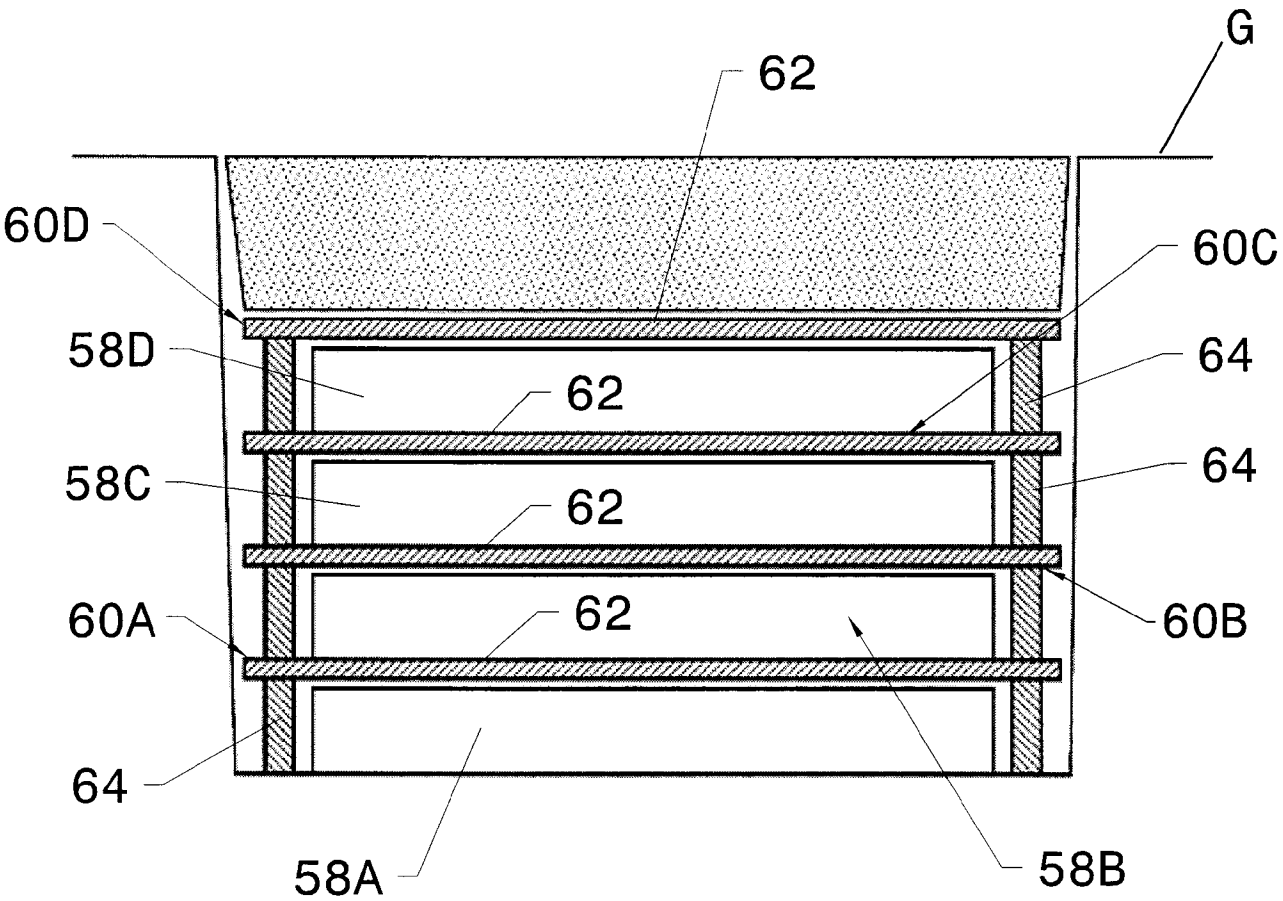
FIG. 12 shows the interment container shown in FIG. 1, containing spacing arrangement for spacing a plurality of coffins.

FIG. 12 shows a situation, where an interment container 12 is intended to be used to hold a plurality of coffins 58. In such a situation, a spacing arrangement 60 may be provided within the interment container 12 to shield the coffins 58 from damage. In FIG. 12, the interment container 12 is shown in the ground G.

In FIG. 12 four coffins 58 are arranged within the interment container 12 and are designated 58A, 58B, 58C and 58D respectively. In order to shield the four coffins 58A, 58B, 58C and 58D, four of the spacing arrangements 60 are provided, designated respectively 60A, 60B, 60C, and 60D. The spacing arrangements 60A, 60B, 60C, and 60D protect the coffins 58A, 58B, 58C and 58D respectively. Although FIG. 12 shows the use of the spacing arrangements with six coffins in the interment container, there could be any other suitable number of coffins therein.

The provision of the spacing arrangement 60 has the advantage that it prevents damage to the coffins, for example during exhumation or relocation. The spacing arrangement 60 also provides the several advantages in the embodiment described above, such as protecting the coffins from damage, providing additional support for the coffins, avoiding soil contact Each spacing arrangement 60 comprises a generally planar support platform 62 which is arranged over the coffin 58. Each spacing arrangement 60 also has support means in the form of a plurality of legs 64 extending downwardly from the respective support platform 62. The lowermost coffin 58A is arranged on the base 15 of the interment container 12, and the lowermost spacing arrangement 60A is arranged over the coffin 58A. The second coffin 58B can be arranged upon the support platform 62 of the lowermost spacing arrangement 60A, and the second spacing arrangement 60B arranged to shield the second coffin 58B.

The second spacing arrangement 60B is arranged on the support platform 62 of the first spacing arrangement 60A as shown. This can be repeated until the desired number of coffins 58 has been arranged within the interment container 12, with each coffin 58B to 58C, with the exception of the lower coffin 58A, being arranged upon the support platform 62 of the spacing arrangement 60 below. FIG. 12 shows the use of four spacing arrangements to protect four coffins, but it will be appreciated that the interment container 12 can be of different sizes, and can hold any suitable number of coffins, such as five or six. In such circumstances, the appropriate number of spacing arrangements 60 will be provided to protect the coffins in the interment container 12.

The provision of the spacing arrangement has the advantage in the embodiments described herein that, where a plurality of coffins are interred within one of the interment containers 10, the upper coffins do not crush the lower coffins.

Figure 13:
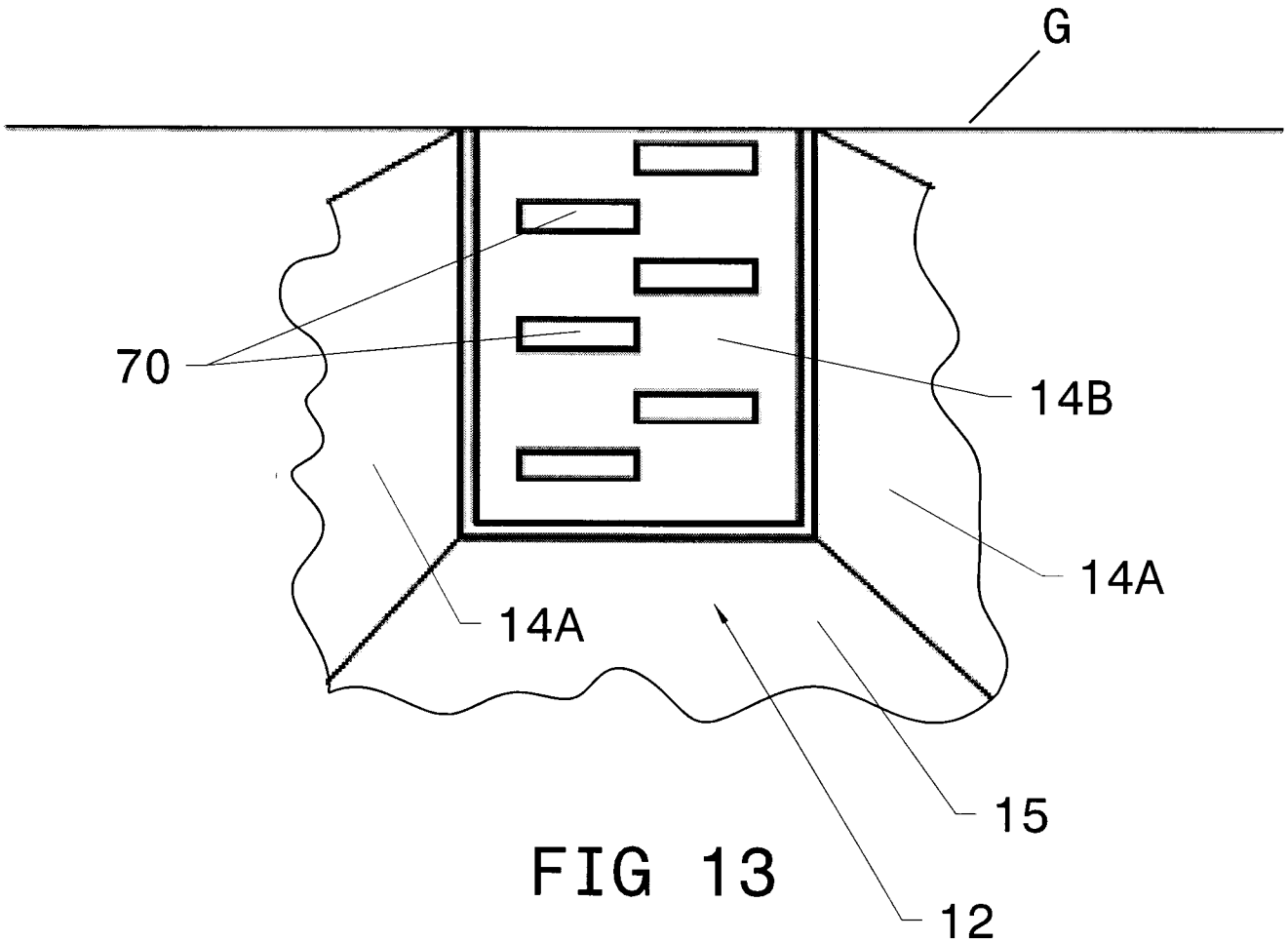
FIG. 13 shows an internal region of the interment container shown in FIG. 1.

FIG. 13 shows an inside view of an interment container 12, in which one of the walls 14B is provided with footings 70 to allow a person to climb out of the interment container 12. As can be seen, the footings 70 provide steps, upon which the person can climb.

Figure 14:
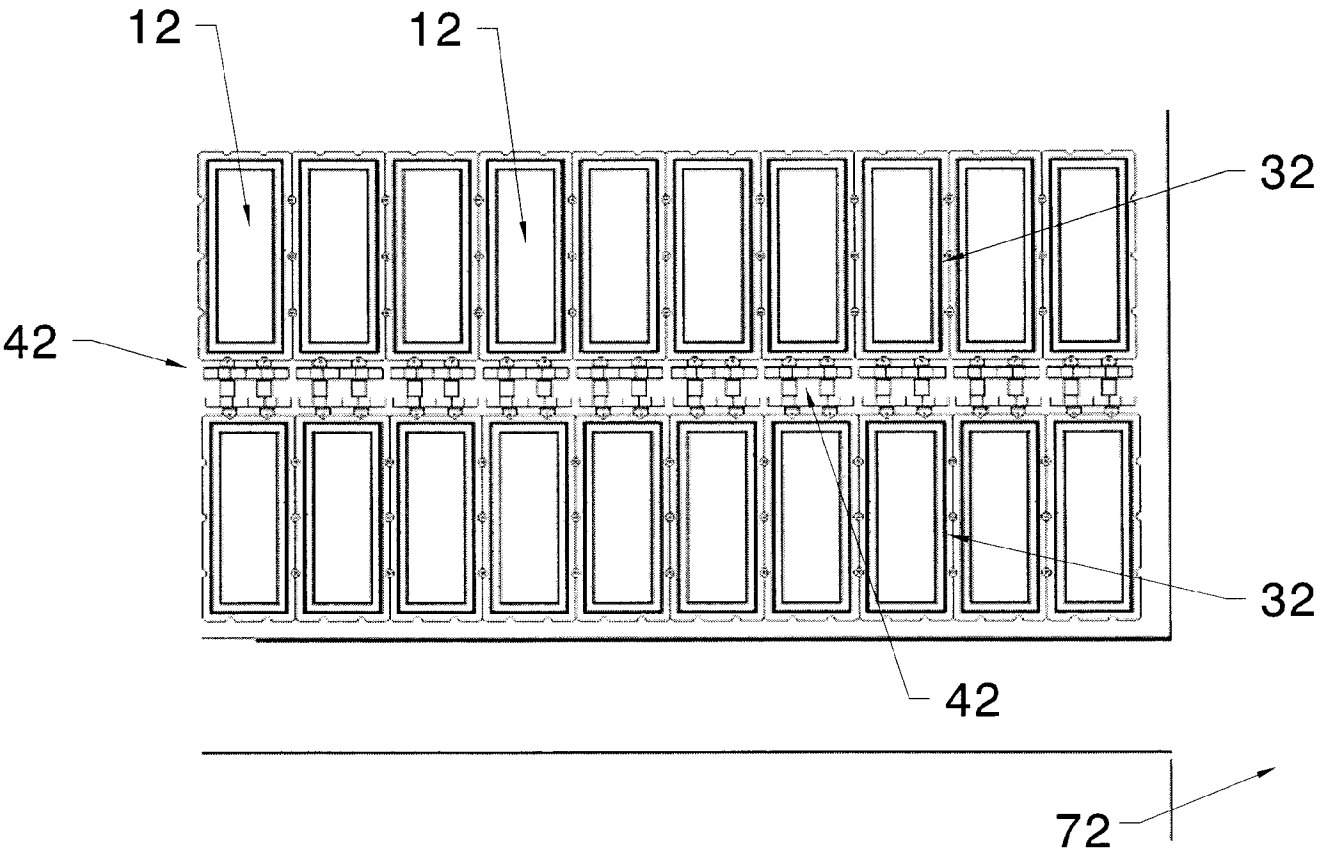
FIG. 14 shows an interment system comprising two rows of interment containers.

FIG. 14 shows an example of an interment system 10, in which an array of a plurality of the interment containers 12 are arranged at a cemetery in two rows back to back with each other.

Locating arrangements 32A or 32B are provided between the adjacent interment containers 12 in each row, and holding arrangements 42 are provided between the two rows of the interment containers 12. Walkways 72 are provided adjacent the array of the interment containers 12.

Figure 15:
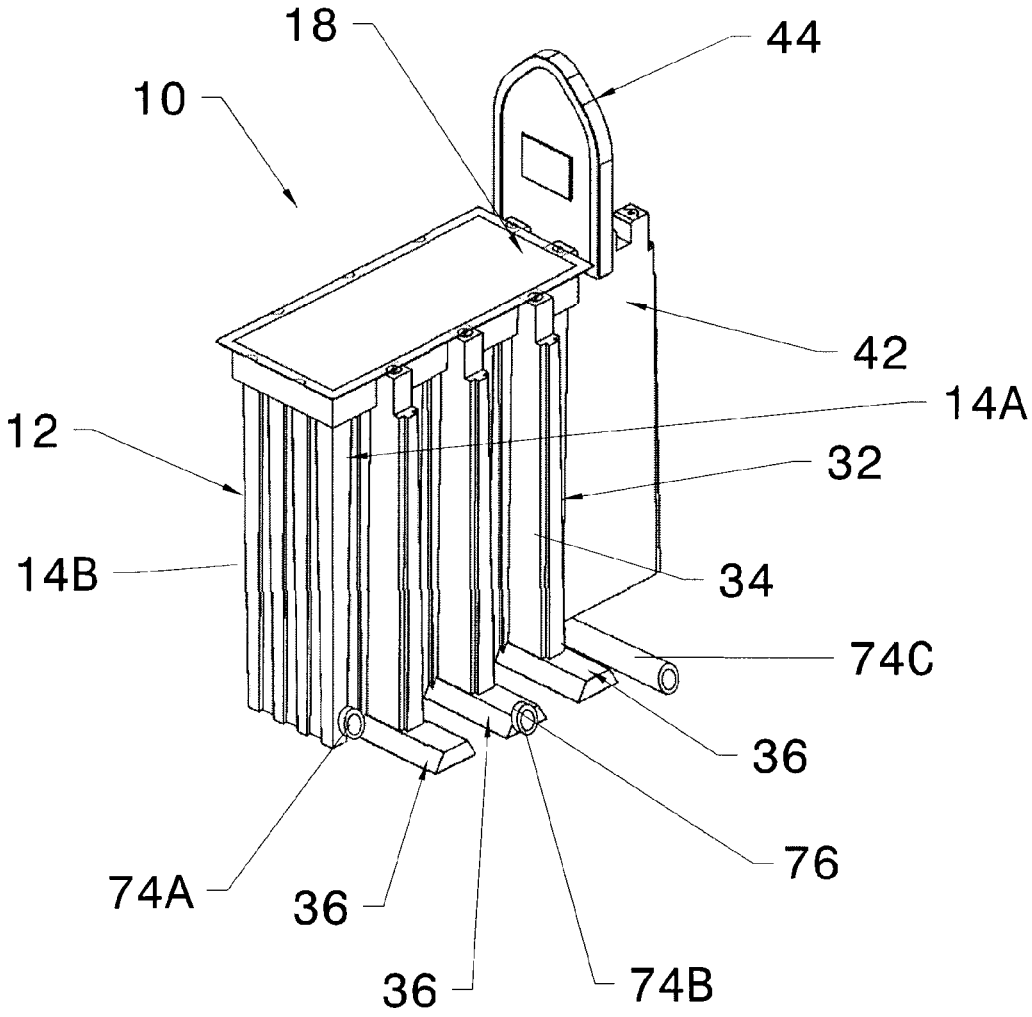
FIG. 15 shows an interment system similar to the interment system shown in FIG. 1, but with drainage means.
Figure 16:
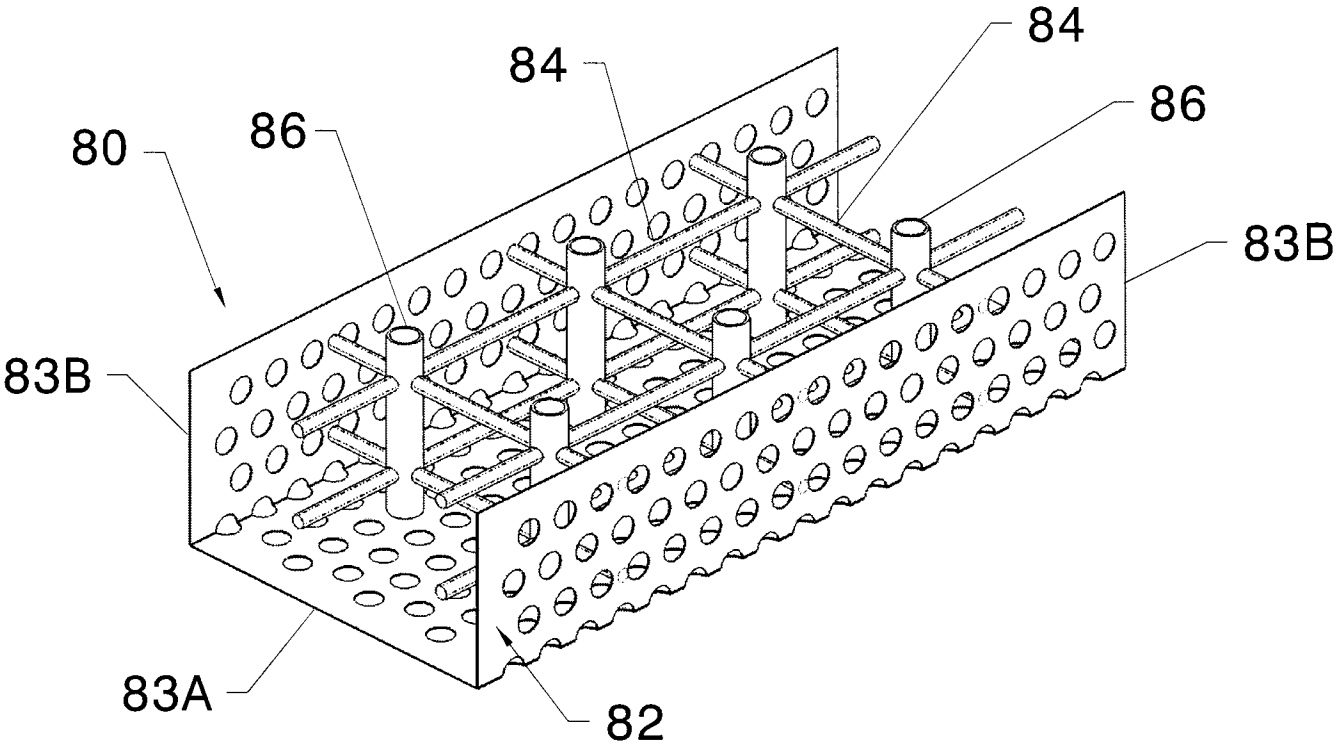
FIG. 16 shows an anchor member of an anchor system.

FIG. 15 shows a view similar to FIG. 1 of a further embodiment which includes drainage means in the form of a plurality of drainage conduits 74 that are arranged to drain water from the ground around the interment system 10. FIG. 15 shows three possibilities for the arrangement of the drainage conduits 74, designated respectively 74A, 74B and 74C.

The drainage conduit 74A is in the form of a short pipe that extends only a short distance from the side wall 14A. The drainage conduit 74A can be used where a further interment container 12 is disposed adjacent the wall 14A from which the drainage conduit 74A extends. The drainage conduit 74B extends from the sidewall 14A through a bore 76 in the stabilising member 36. The drainage conduit 74C extends from the interment container 12 to a position beyond the stabilising members 36. The drainage conduits 74B and 74C can be used where there is no interment container 12 adjacent the wall 14A from which the drainage conduits 74B or 74C extend. The drainage conduits 74 may comprise standard plastic drainage pipes, which may be cut or formed in suitable lengths, as shown.

Various modifications can be made without departing from the scope of the invention. For example, the widths of the locating arrangements and the holding arrangements may vary to allow the interment containers to be spaced from each other by different distances.

Figure 17:
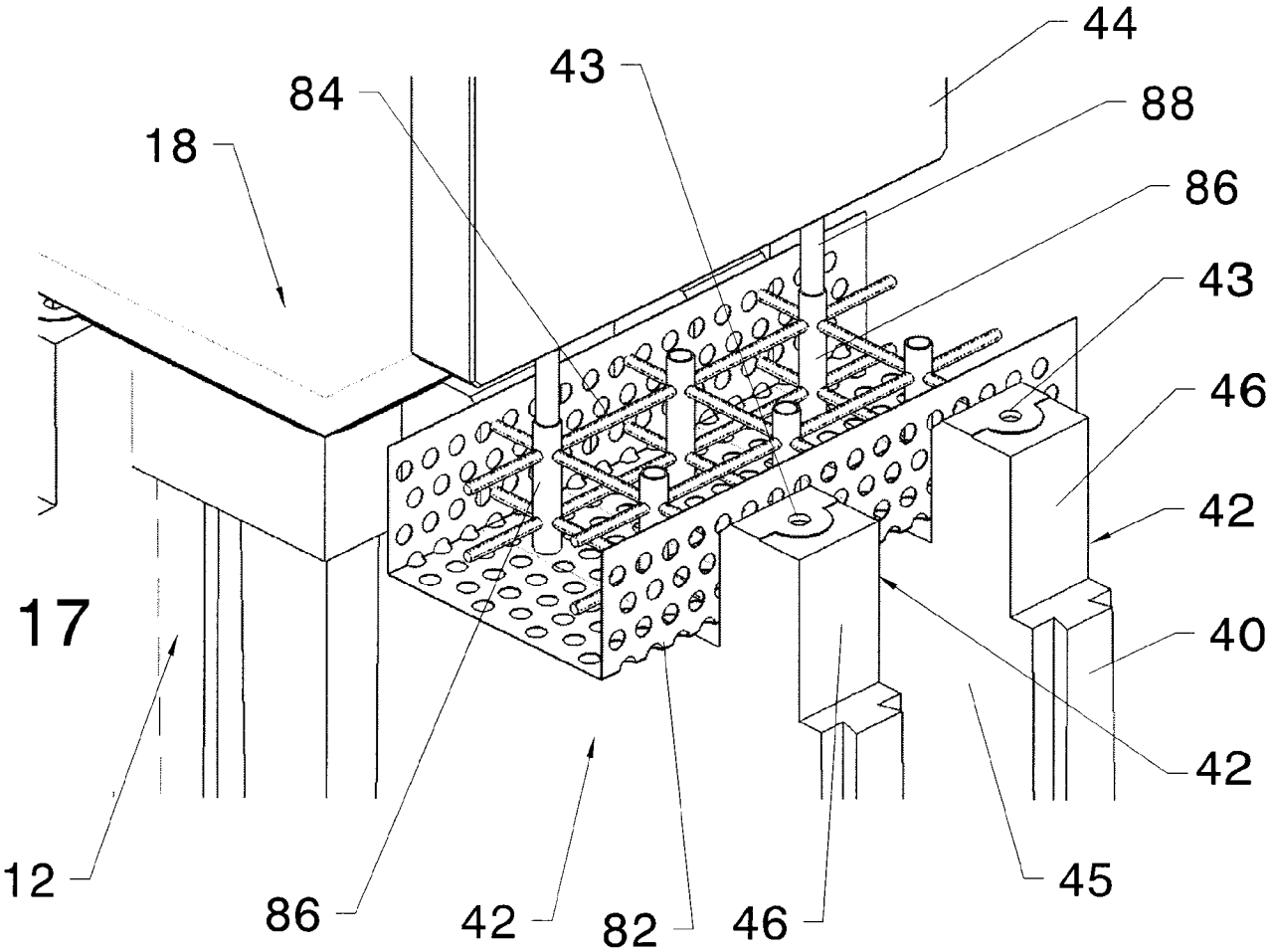
FIG. 17 shows the anchor member of FIG. 16 in use.
Figure 18:
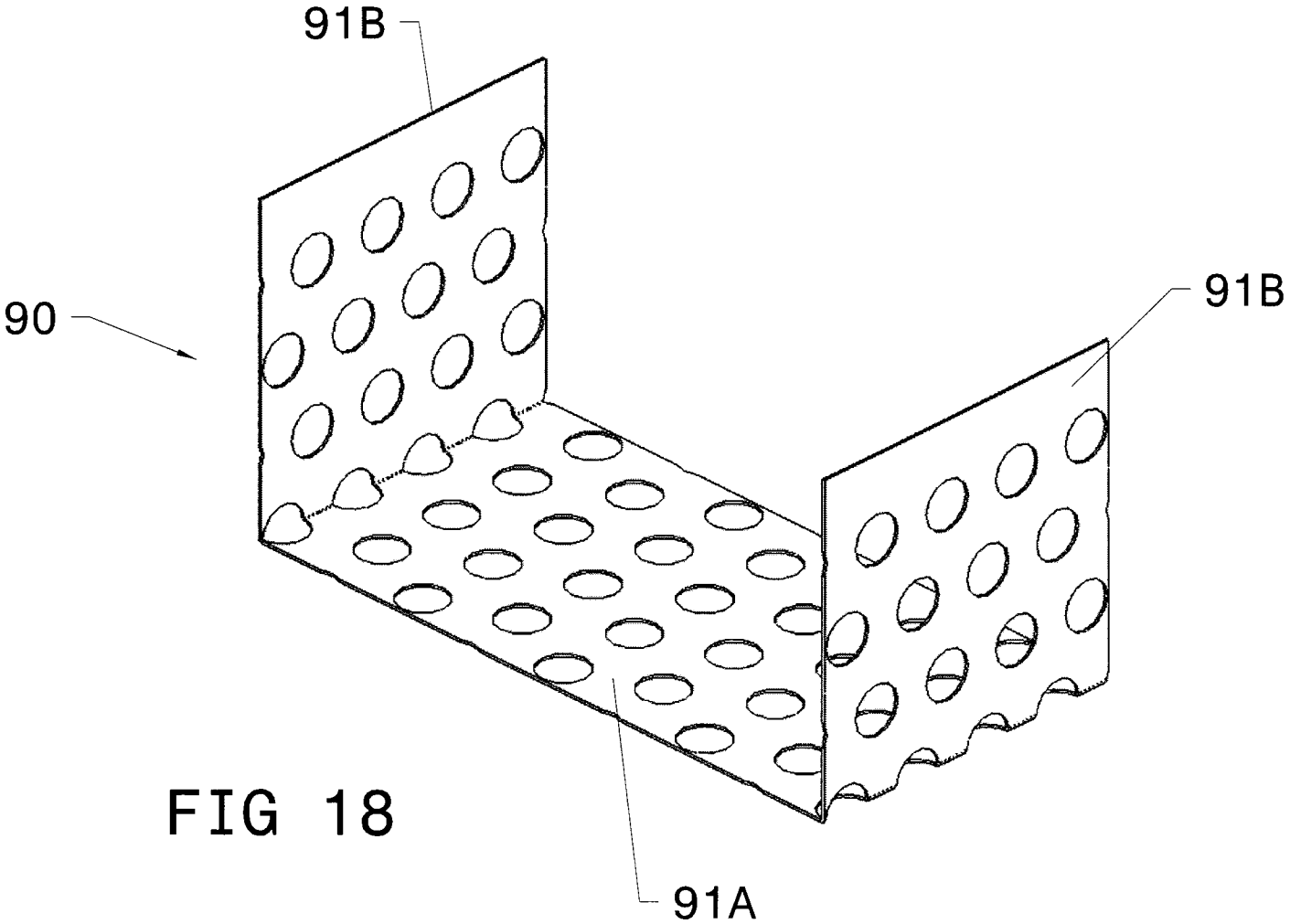
FIG. 18 shows a joining member for joining adjacent anchor members.

In one modification, shown in FIGS. 16 to 20, an anchor system 80 is provided for anchoring a item, such as a headstone 44 (see FIG. 17). The anchor system 80 comprises anchor member 82 in which stabilising means in the form of concrete can be disposed. The anchor member 82 has a generally U shaped profile having a rectangular base 83A and a pair of upstanding side walls 83B extending from opposite edges of the base 83A. The base 83A and the side walls 83B are formed of a perforated metal plate, which may be deformed into the U-shaped profile.

The anchor system 80 comprises reinforcement in the form of rebars 84 on the anchor member 82 to reinforce the concrete. The rebars 84 are mounted on fixing formations in the form of a plurality of upstanding tubes 86. The headstone 44 includes insertion members 88 extending downwardly from the lower face thereof. The tubes 86 are configured to receive the insertion members 88, thereby anchoring the headstone 44 on the anchor system 80.

The anchor system 80 is disposed on the holding arrangements 42 between adjacent projecting members 46. As can be seen, the holding arrangements 42 shown in FIG. 17 have only two outer projecting members 46, instead of three possessed by the holding arrangements 42 shown in FIG. 5, the central projecting member 46 being omitted from the holding arrangement 42 shown in FIG. 17. With the anchor member 82 disposed on the holding arrangements 42, the headstone 44 is lowered onto the anchor member 80 so that the insertion members 88 are received in the tubes 86, thereby anchoring the headstone 44 in place. It will be appreciated that, instead of anchoring a headstone 44, a plinth (not shown) can be anchored by the anchor system 80, and the headstone 44 mounted on the plinth. In such a case, the plinth is provided with the insertion members 88.

Where a plurality of interment containers 12 are arranged side by side, for example as shown in FIGS. 6 and 7, the anchor system 80 comprises a plurality of anchor members 82, whereby a respective anchor member 82 is provided for each interment container 12. With such an arrangement, the gap between adjacent anchor members 82 is bridged by respective joining members 90. Each joining member 90 has a U shaped profile with a rectangular base 91A and upstanding sidewalls 91B extending from opposite edges of the base 91A. The base 91A and the side walls 91B are formed of a perforated metal plate, which may be deformed into the U-shaped profile.

Figure 19:
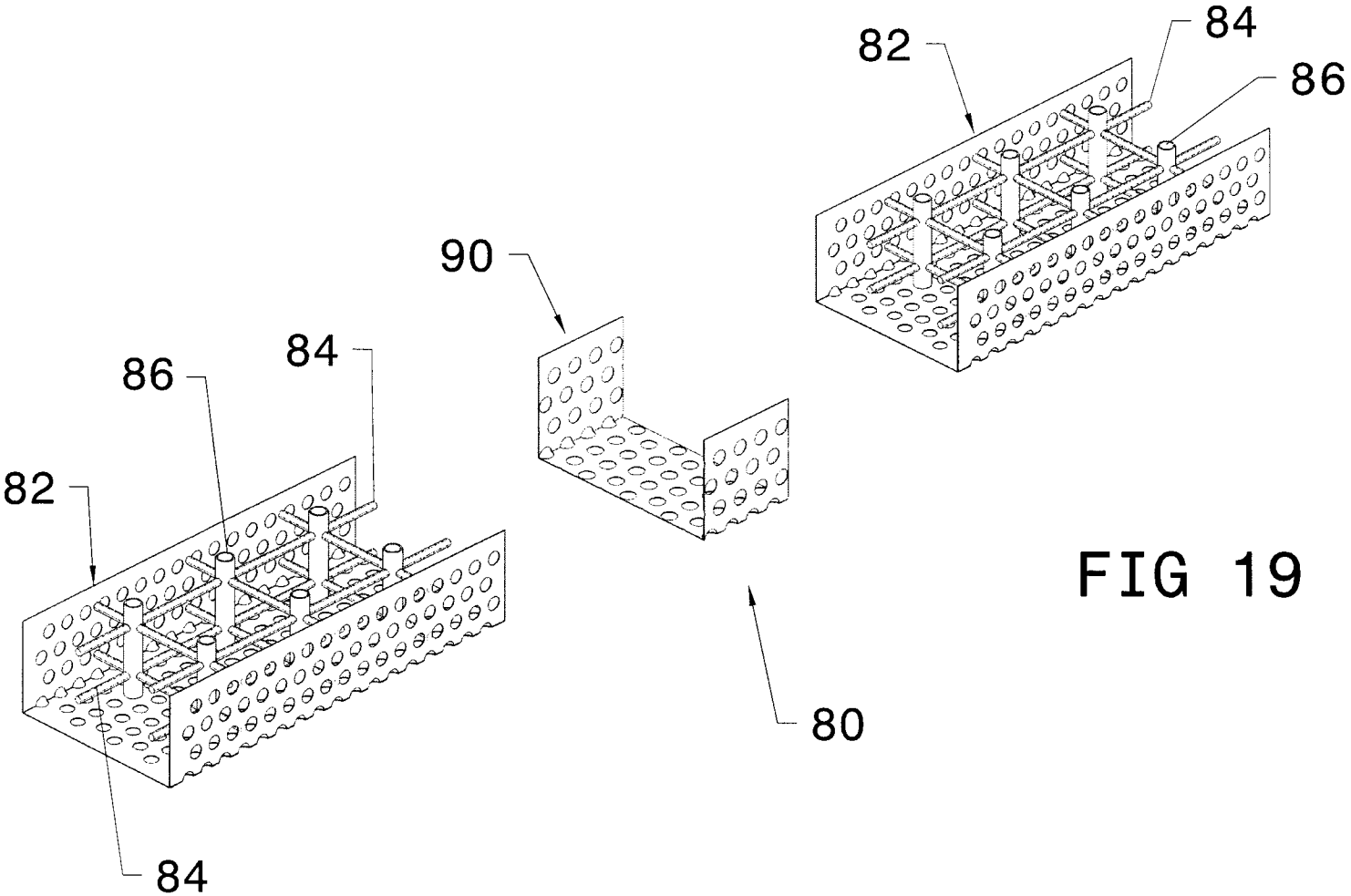
FIG. 19 shows a joining member between adjacent anchor members.

In use, the joining members 90 are disposed between adjacent anchor members 82, with the base 91A of the joining member 90 in engagement with the bases 83A of both anchor members 82, and with the side walls 91B of the joining member 90 in engagement with the side walls 83B of both anchor members 82. Concrete is then poured onto the anchor members 82 between the side walls 83B and into the, or each, joining member 90 between the side walls 91B. The anchor members 82 and the, or each, joining member 90 are thus filled with the concrete. FIG. 19 shows two anchor members 82 and a joining member 90 therebetween.

Figure 20:
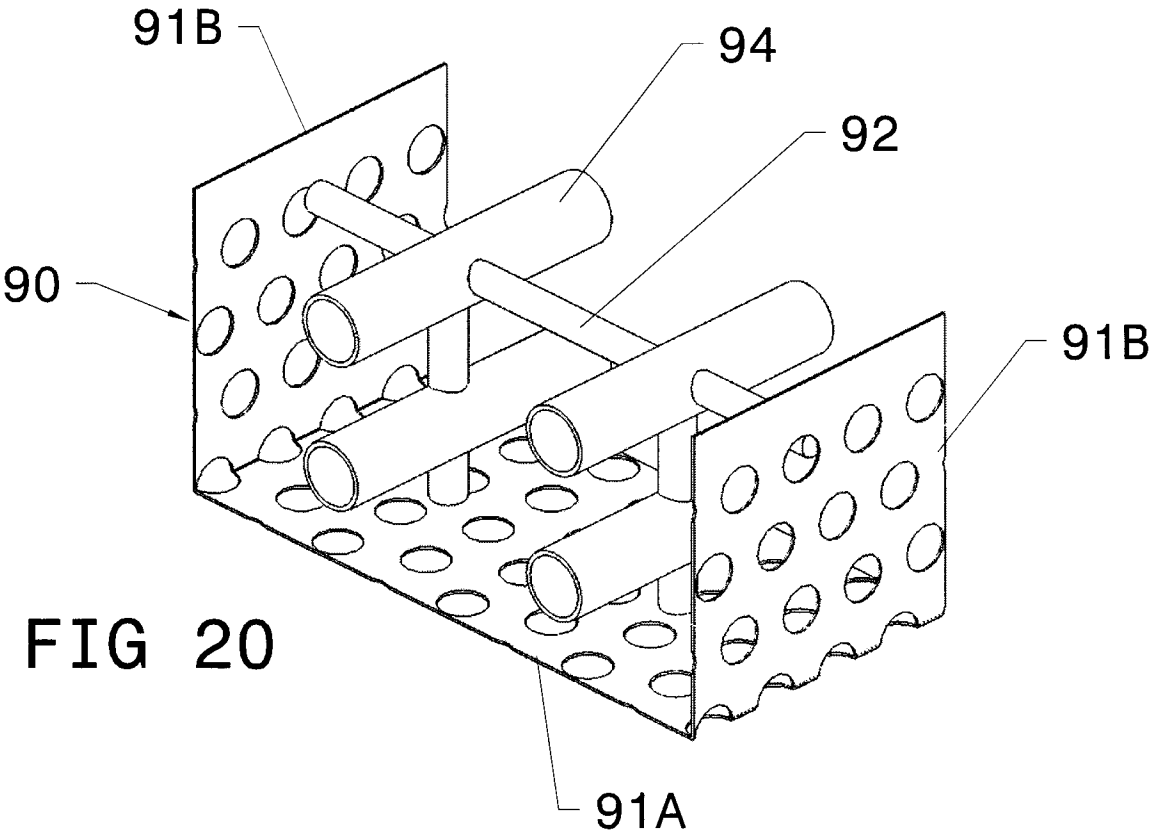
FIG. 20 shows the joining member of FIG. 18 with reinforcement and connecting members.
Figure 22:
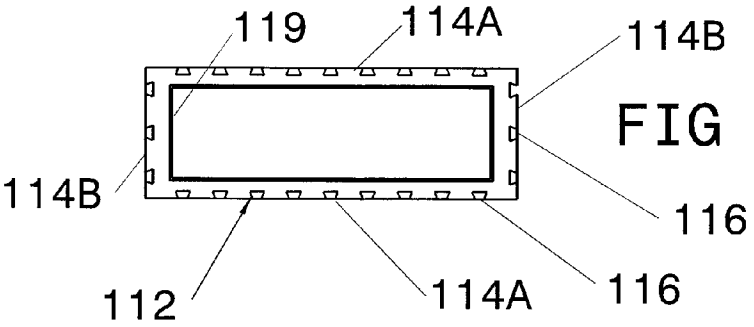
FIG. 22 is a top plan view of the outer interment container shown in FIG. 21.
Figure 23:
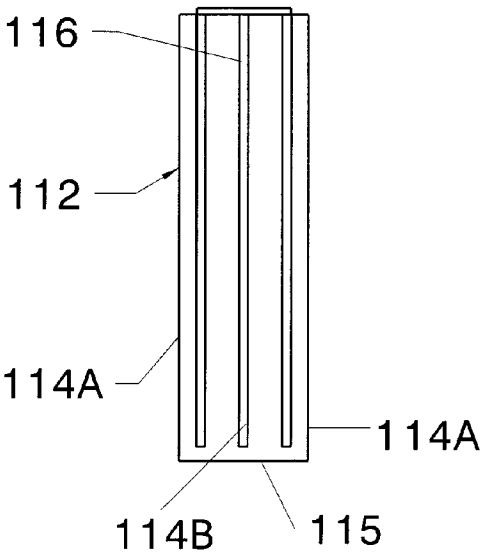
FIG. 23 is an end view of the outer interment container shown in FIG. 21.
Figure 21:
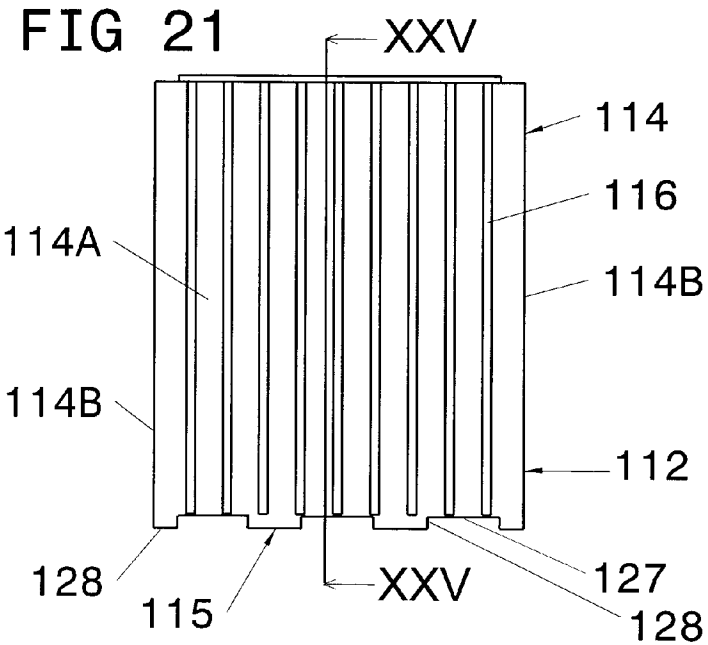
FIG. 21 is a side view of an embodiment of an outer interment container.
Figure 24:
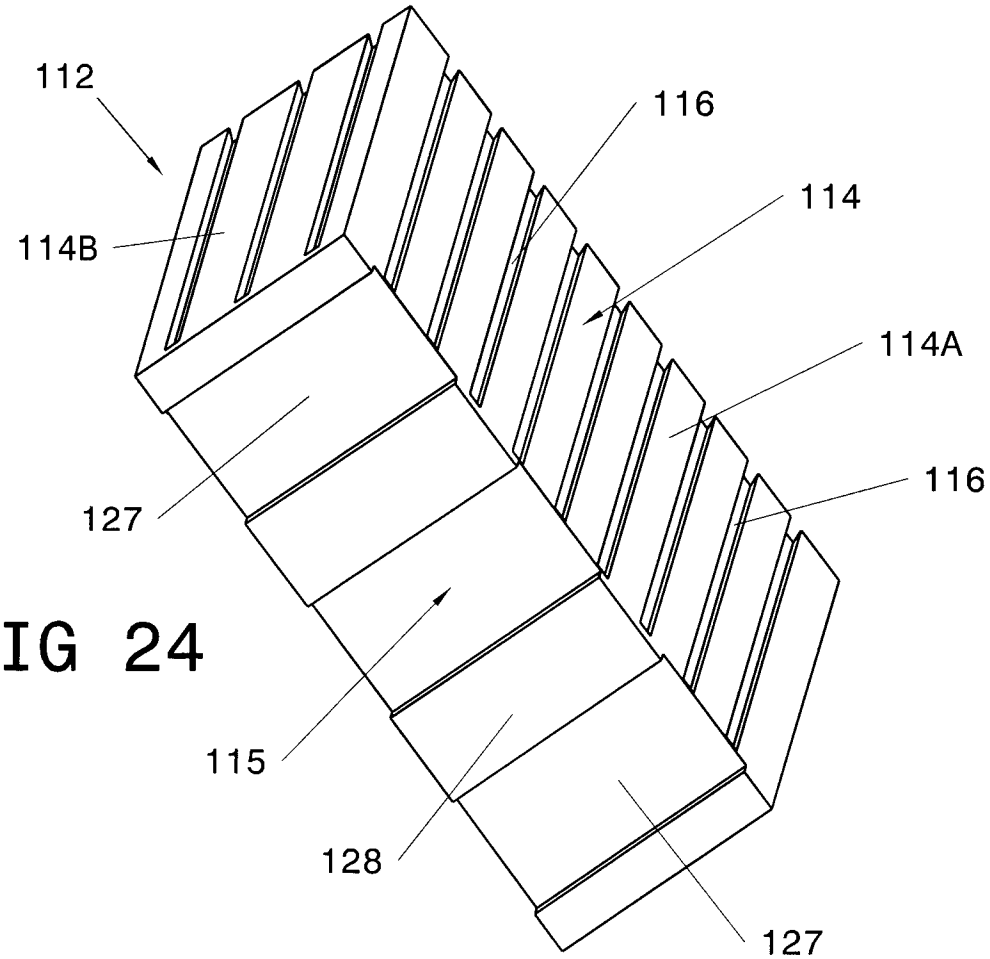
FIG. 24 is a bottom perspective view of the outer interment container shown in FIG. 21.

FIG. 20 shows the joining member 90 in which rebars 92 and connecting members 94 are provided. The connecting members 94 are in the form of tubes and receive end regions of the rebars 84 in the anchor members 82 to connect the adjacent anchors members 82 to the connecting member 94.

The above described embodiments have the advantages that exhumation is facilitated, and the system saves space over prior art systems. A further advantage of the above described embodiments is that they can facilitate mass burial in the cases of pandemics and war. Also, the above described embodiments can be used in loose ground conditions. The embodiments described above have the following additional advantages: the interment system 10 is eco friendly, requiring minimal raw materials; the interment containers 12 are waterproof, thereby preventing groundwater contamination, and also prevents contamination to the ground and the water table; the interment system 10 is rigid and shock proof, and is easily movable; and prevents soil touching the coffin, where this is a custom of the deceased.

There is thus described an interment system for use in the formation of graves that allows a simple and efficient manner of performing burials and disposing of the deceased.

Figure 33:
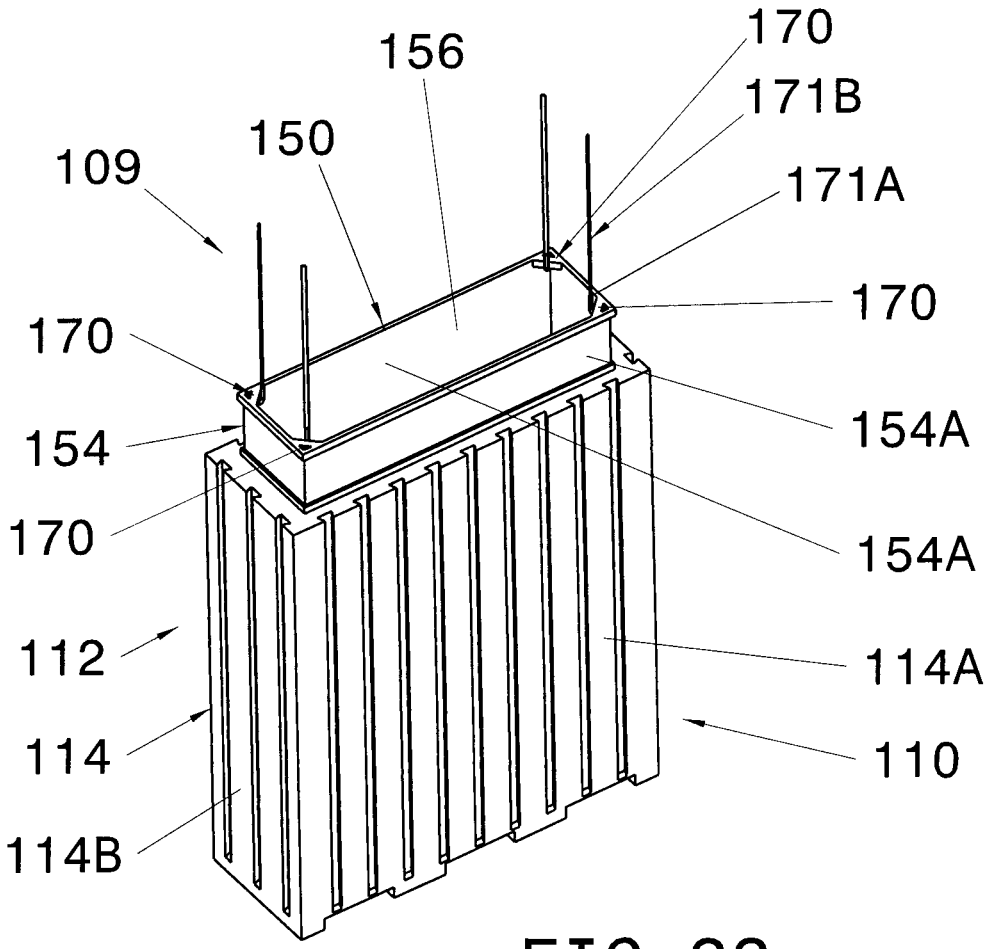
FIG. 33 shows an embodiment of an interment system, with the inner interment container shown in FIGS. 26 to 32 being lowered into, or lifted out of, the outer interment container shown in FIGS. 21 to 25.

A further embodiment of the invention is shown in FIGS. 21 to 60, and is similar to the embodiment shown in FIGS. 1 to 15. The embodiment shown in FIGS. 21 to 60 comprises an interment system 110 (see FIG. 33), which comprises a container arrangement 109 comprising an outer interment container 112, shown in FIGS. 21 to 26, and an inner interment container 150 shown in FIGS. 27 to 32. The outer interment container 112 comprises an outer body 114 having an outer base 115, and an upstanding outer wall arrangement comprising a pair of opposite outer side walls 114A and opposite outer front and rear walls 114B. The outer walls 114A, 114B extend upwardly from the outer base 115. An inner container receiving space 119 is defined by the body 114 for receiving the inner container 150. The outer walls 114A, 114B comprise a cooperating arrangement in the form of a plurality of parallel dovetail recesses 116, each having a dovetail profile. The dovetail recesses 116 extend from the top of each wall 114A, 114B to a region adjacent the base 115.

Each of the dovetail recesses 116 is co-operable with a connecting member 117, or a further connecting member 121 (see FIGS. 38 to 41). The connecting members 117, 121 connect the outer interment container 112 to an adjacent outer interment container 112, to allow a plurality of the interment systems 110 to be connected to one another in succession.

Figure 26:
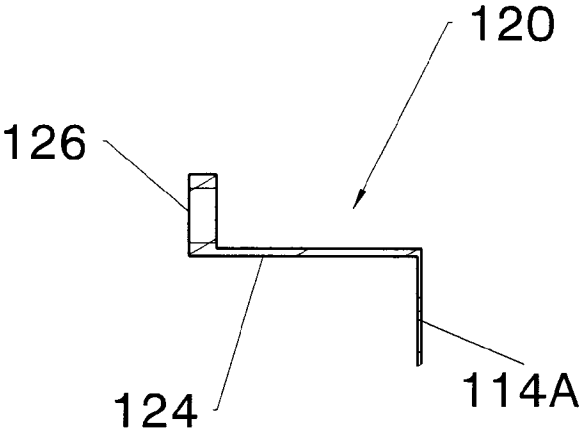
FIG. 26 is a close up view of the region marked XXVI in FIG. 24.
Figure 25:
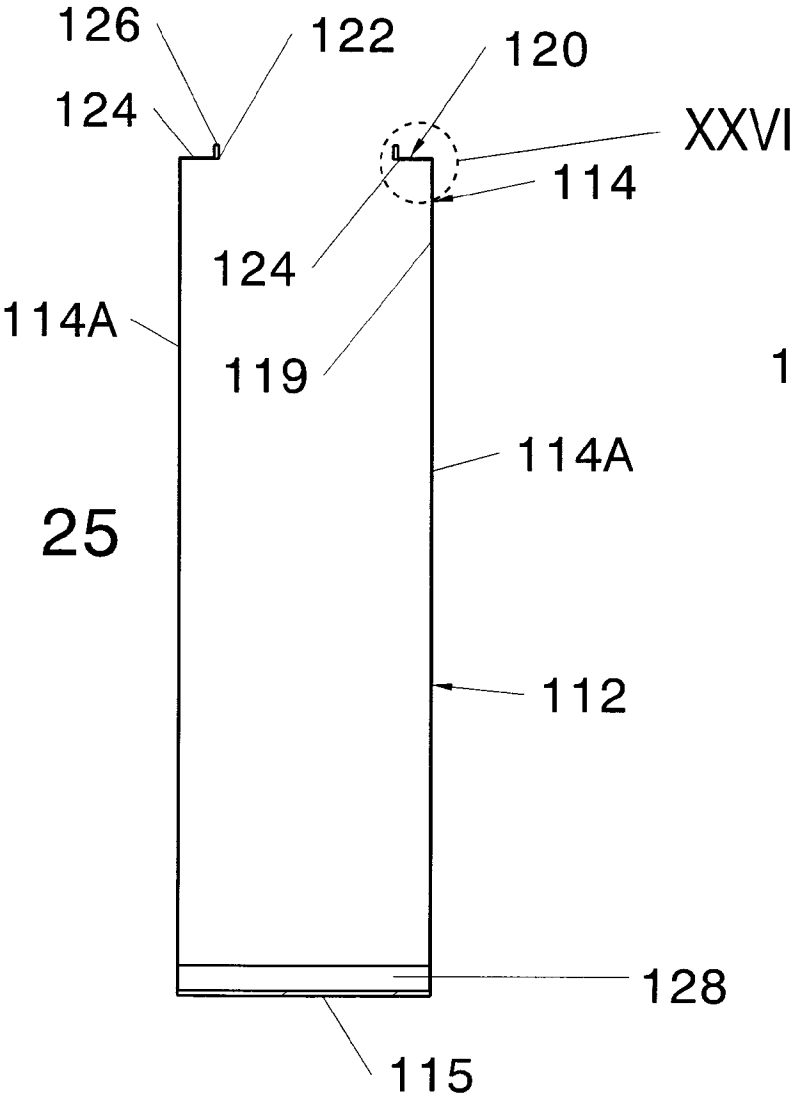
FIG. 25 is a view along the lines XXV-XXV in FIG. 21.
Figure 28:
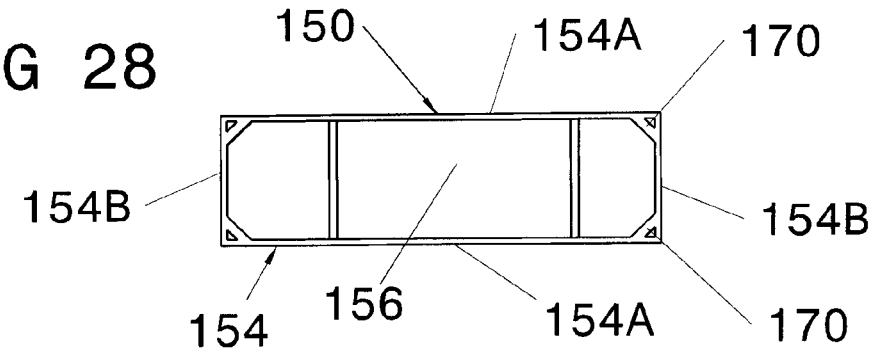
FIG. 28 is a top plan view of the inner interment container shown in FIG. 27.
Figure 27:
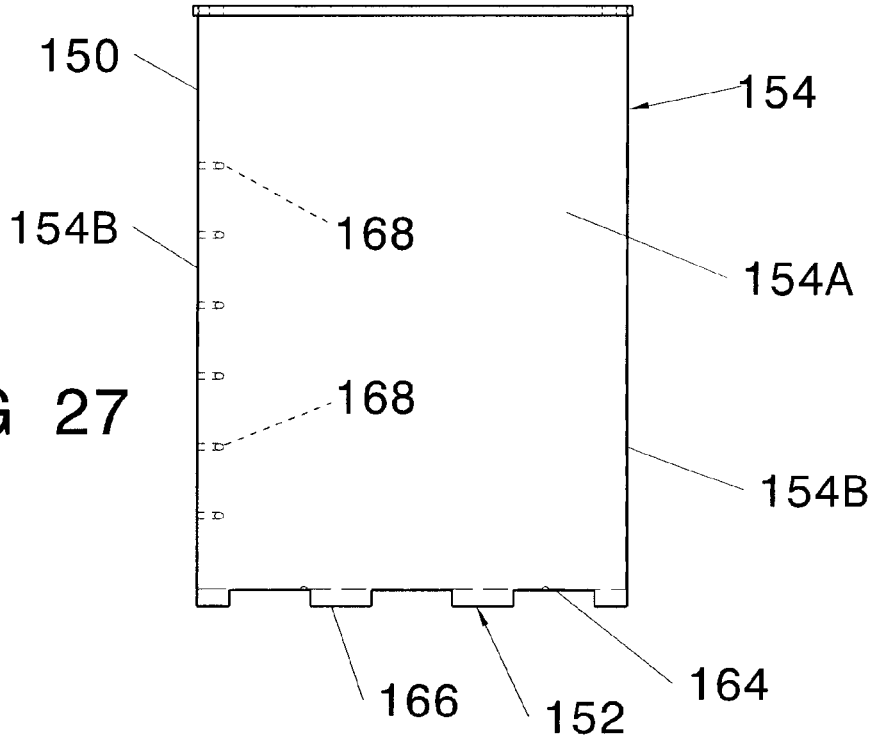
FIG. 27 is a side view of an embodiment of an inner interment container.
Figure 29:
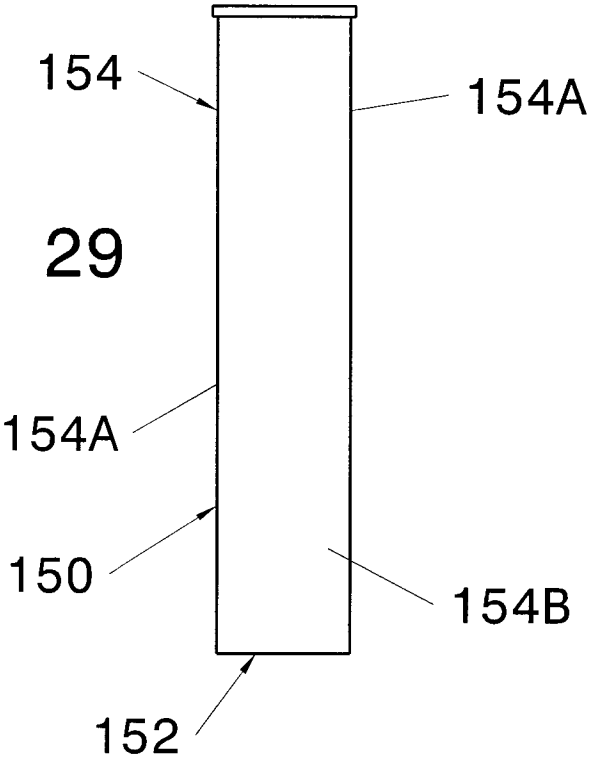
FIG. 29 is an end view of the inner interment container shown in FIG. 27.
Figure 30:
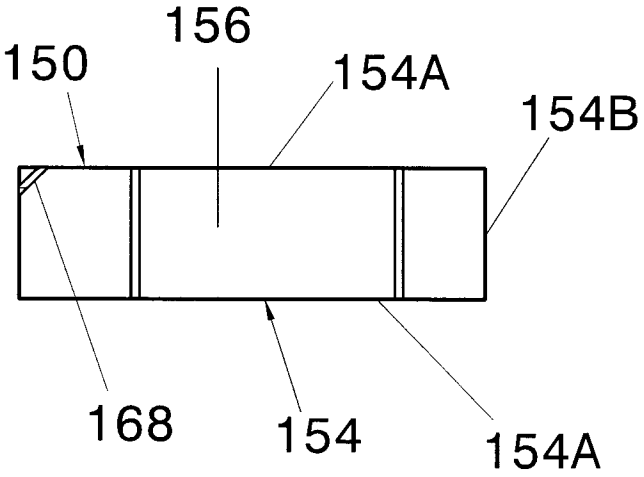
FIG. 30 is a cross sectional top view of the inner interment container shown in FIG. 27.
Figure 32:
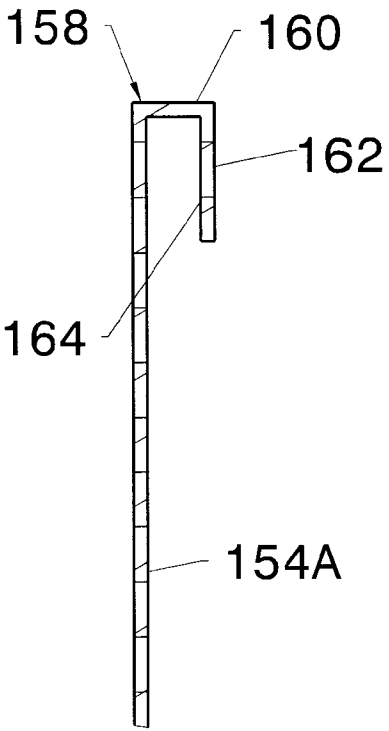
FIG. 32 is a close up view of the region marked XXXII in FIG. 31.
Figure 31:
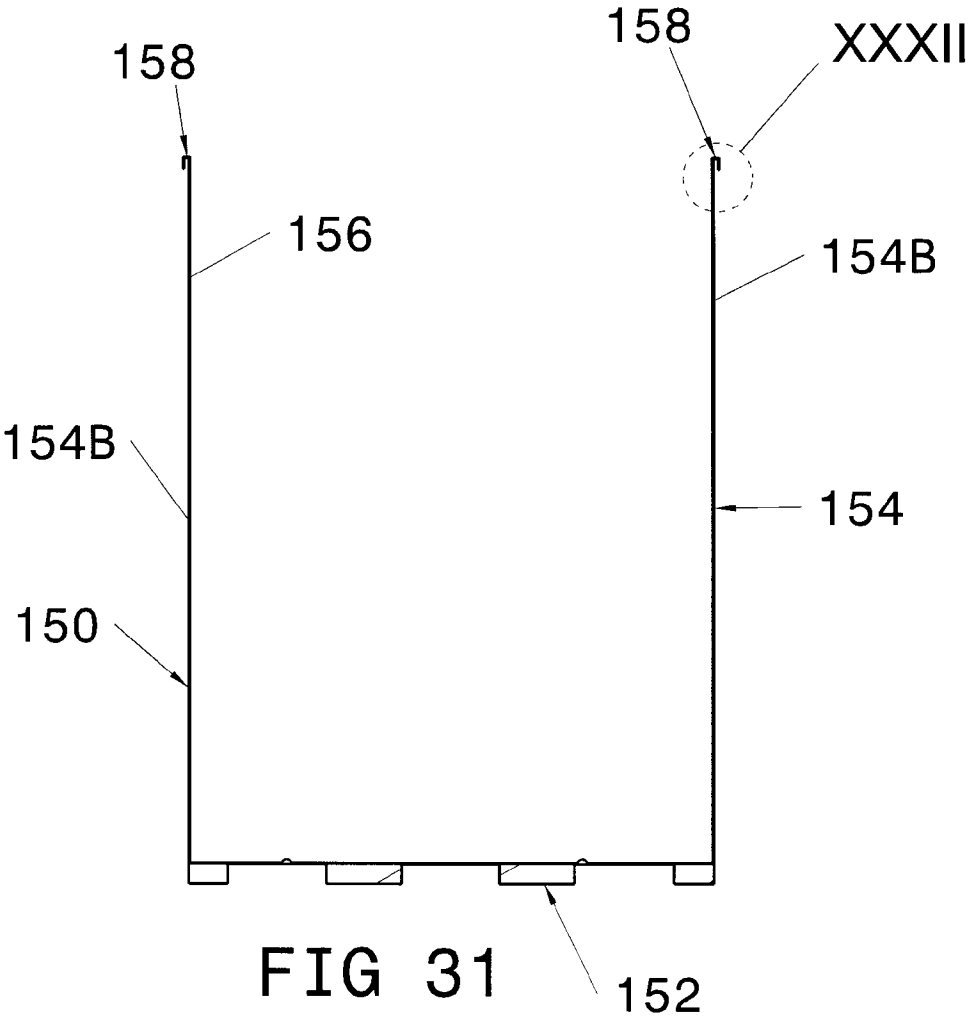
FIG. 31 is a cross sectional side view of the inner interment container shown in FIG. 27.

Referring to FIGS. 25 and 26, the outer interment container 112 has at its upper end an inwardly extending flange arrangement 120 defining an opening 122. The inwardly extending flange arrangement 120 comprises a flange portion 124 extending inwardly from the top edge of each of the walls 114A, 114B. The inner edge of the flange portion 124 has an upwardly extending rim portion 126 to engage an upper region of the inner interment container 150, as explained below. The outer base 115 comprises a planar base portion 127 and a plurality of downwardly extending feet 128 to engage the ground within a trench.

Figure 48:
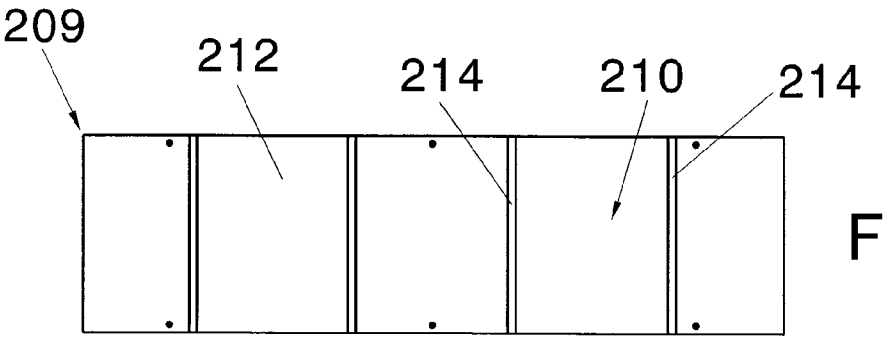
FIG. 48 is a to plan view of an embodiment of a spacing arrangement.
Figure 49:
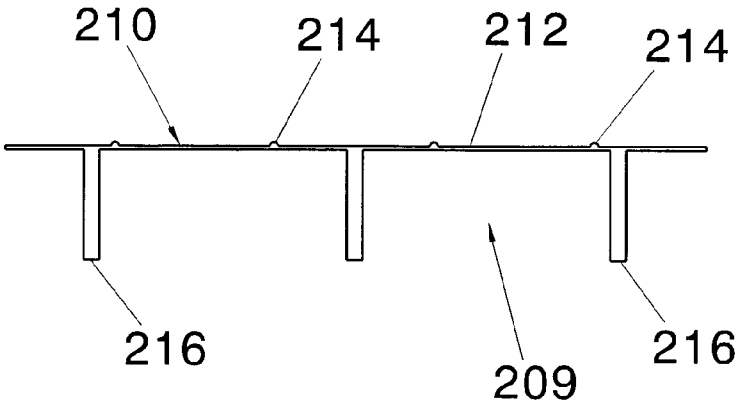
FIG. 49 is a side view of the spacing arrangement shown in FIG. 47.
Figure 50:
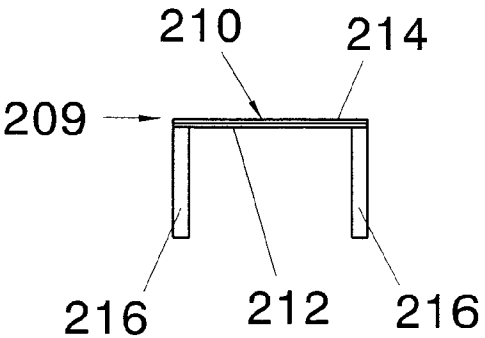
FIG. 50 is an end view of the spacing arrangement shown in FIG. 47.

The inner interment container 150 is shown in FIGS. 27 to 32, and comprises an inner body 154 having an inner base 152 and an inner wall arrangement comprising a pair of opposite inner side walls 154A and opposite inner front and rear walls 154B. The walls 154A and 154B extend upwardly from the inner base 152. The inner walls 154A, 154B and the inner base 152 define a posthumous remains receiving chamber 156 in which a plurality of coffins can be disposed one above the other upon a plurality of support arrangements, one of which is shown in FIGS. 48 to 50, and is described below.

The inner container 150 includes an outwardly extending lip arrangement 158 extending outwardly from the inner walls 154A, 154B at their upper edges. The outwardly extending lip arrangement 158 is provided to engage over the upwardly extending rim portion 126 of the outer container 112, when the inner container 150 is received by the outer container 112. The outwardly extending lip arrangement 158 comprises an outwardly extending web portion 160 and a downwardly extending lip portion 162. The downwardly extending lip portion 162 and the walls 154A, 154B define a recess 164 to receive the upwardly extending rim portion 126 of the inwardly extending flange arrangement 120 on the outer interment container 112.

The inner base 152 comprises a generally planar main base portion 165 and a plurality of feet 166 extending downwardly from the main base portion 165. The feet 166 engage the outer base 115 of the outer container 112.

A plurality of rungs 168 are provided at one of the corners of the posthumous remains receiving chamber 156 defined by the inner container 150. The rungs extend from a side wall 154A to the adjacent front or rear wall 154B. The purpose of the rungs 168 is to provide a ladder arrangement to allow workers within the posthumous remains receiving chamber 156 to exit therefrom.

Figure 33A:
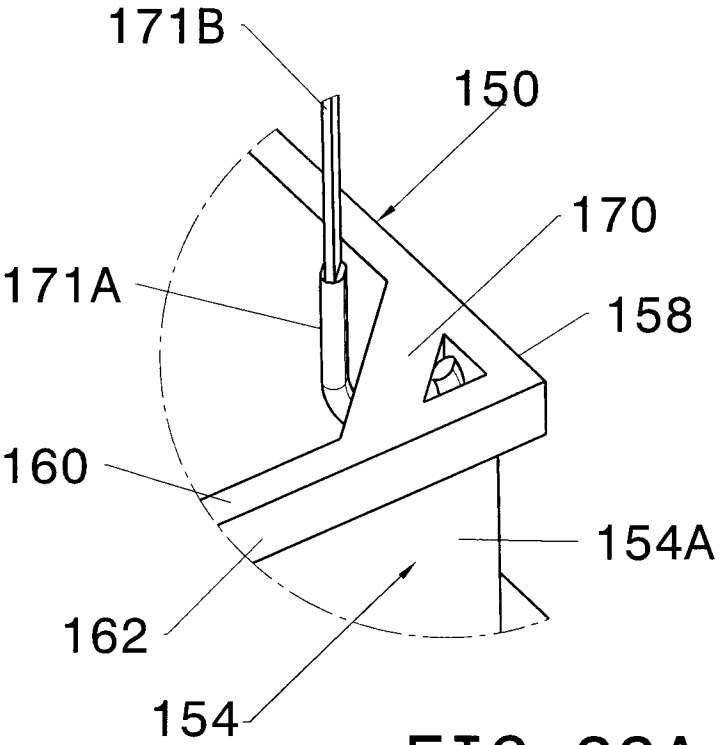
FIG. 33A is a close up of the region marked XXXII in FIG. 32.

The inner container also includes diagonally extending lifting members 170 at each upper corner of the posthumous remains receiving chamber 156. The purpose of the lifting members 170 is to co-operate with a lifting arrangement (see FIGS. 33 and 33A), which may be in the form of a plurality of hooks 171A provided on cables 171B extending from a crane (not shown). The lifting members 170 allow the inner interment container 150 to be lifted into and out of the outer interment container 112, a shown in FIGS. 33 and 33A The interment system 110 further includes a lid arrangement 172 shown in FIGS. 34 and 35. The lid arrangement 172 comprises an insertion member 174 and an outwardly extending engagement member 176 extending around the insertion member 174. The insertion member 174 comprises a bottom member 174A and upright wall members 174B extending from the bottom member 174B. The insertion member 174 defines a coffin receiving space 175 between the bottom member 174A and the wall members 174B. The engagement member 176 extends from the upper edge of the wall members 1748.

The outwardly extending engagement member 176 includes a rectangular outwardly extending flange element 177, and a downwardly extending edge element 178 having a plurality of inwardly extending cooperating members 180 thereon. The downwardly extending edge element 178 extends from the flange element 177. The inwardly extending cooperating members 180 are of a dovetail shape corresponding in shape and size to the dovetail recesses 116 defined by the outer walls 114A and 114B.

When the lid arrangement 172 is mounted on the outer interment container 112, the insertion member 174 is received within the posthumous remains receiving recess 156 of the inner interment container 150. The engagement member 176 extends over the inwardly extending flange arrangement 120 of the outer container 112, and the edge element extends alongside, and substantially parallel to, the outer walls 114A, 114B. In this position, the dovetail members 180 are received in the dovetail recesses 116 defined by the outer walls 114A, 114B of the outer container 112. The lid arrangement 172 also includes opposed handles 181 extending inwardly from two opposite wall members 174B. The handles 181 allow the lid arrangement 172 to be lifted into and out of the inner interment container 150.

Figure 34:
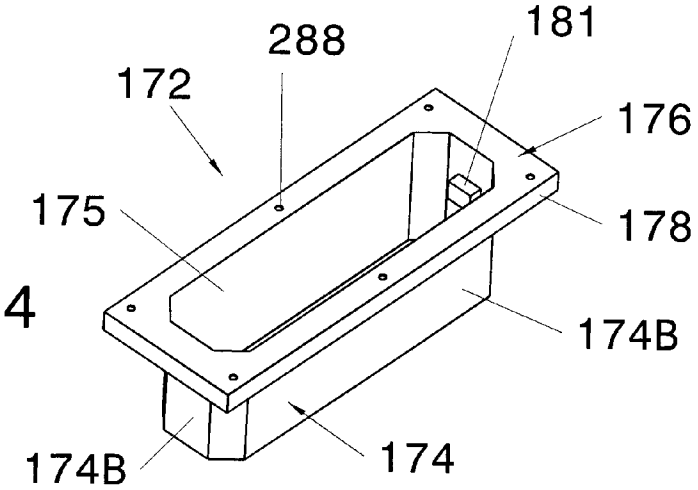
FIG. 34 is a top perspective view of an embodiment of a lid arrangement.
Figure 35:
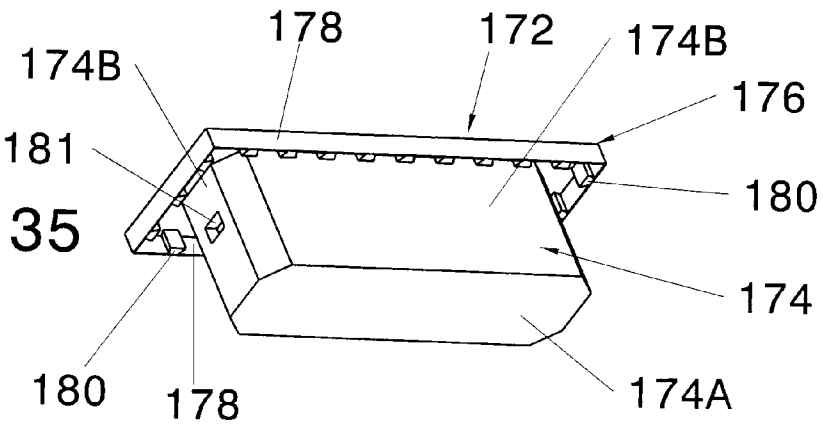
FIG. 35 is a bottom perspective view of the lid arrangement shown in FIG. 34.
Figure 36:
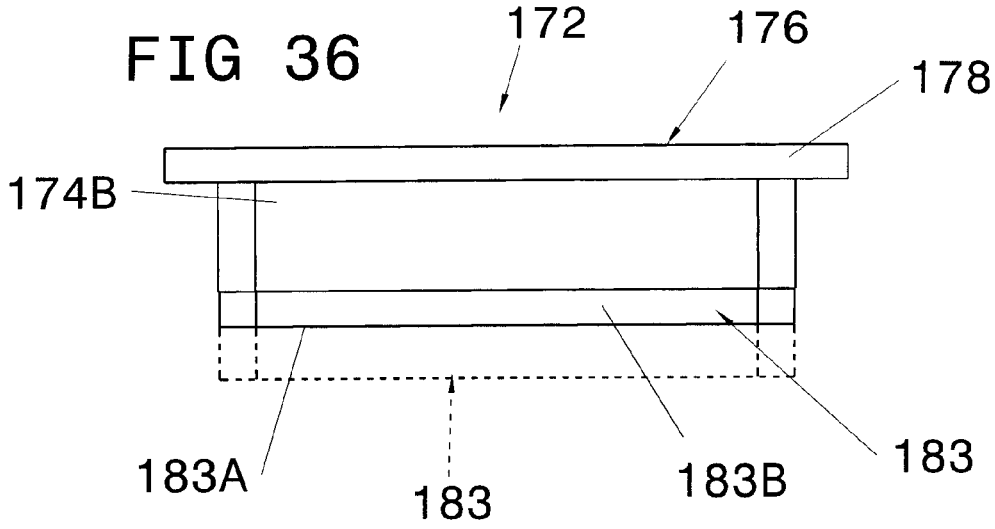
FIG. 36 is a side view of another embodiment of a lid arrangement.
Figure 37:
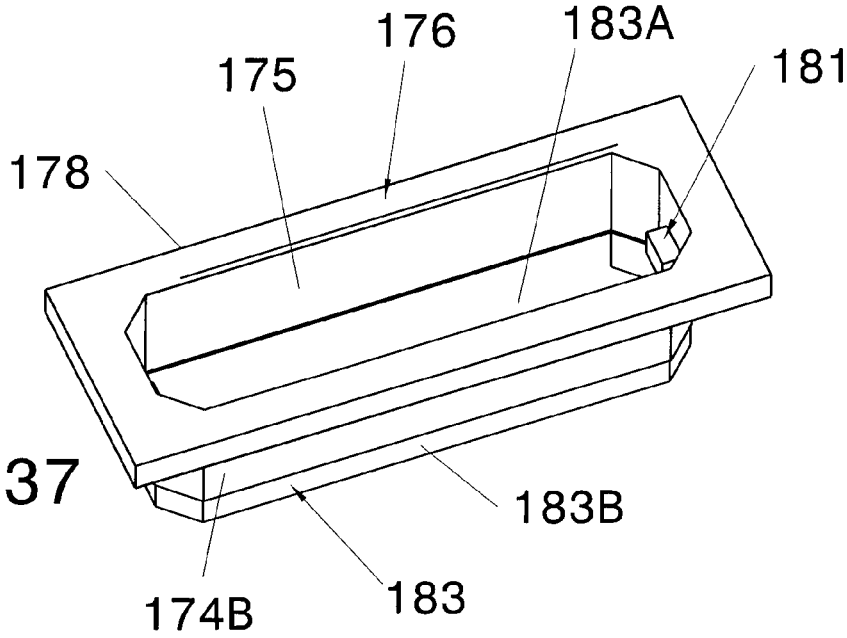
FIG. 37 is a top perspective view of the lid arrangement shown in FIG. 35.

FIGS. 36 and 37 show an alternative embodiment of the lid arrangement 172, which includes all the features of the lid arrangement 172 shown in FIGS. 34 and 35, with the exception that the bottom member 174A is replaced by a retractable bottom arrangement 183, which is telescopically received by the wall members 174B. The bottom arrangement 183 has a bottom member 183A and upright side members 183B extending from the bottom member 183A. The bottom arrangement 183 is slidably movable relative to the wall members 174B between a retracted condition shown in solid lines in FIGS. 36 and 37 and an extended condition shown in broken lines in FIGS. 36 and 37.

Figure 42:
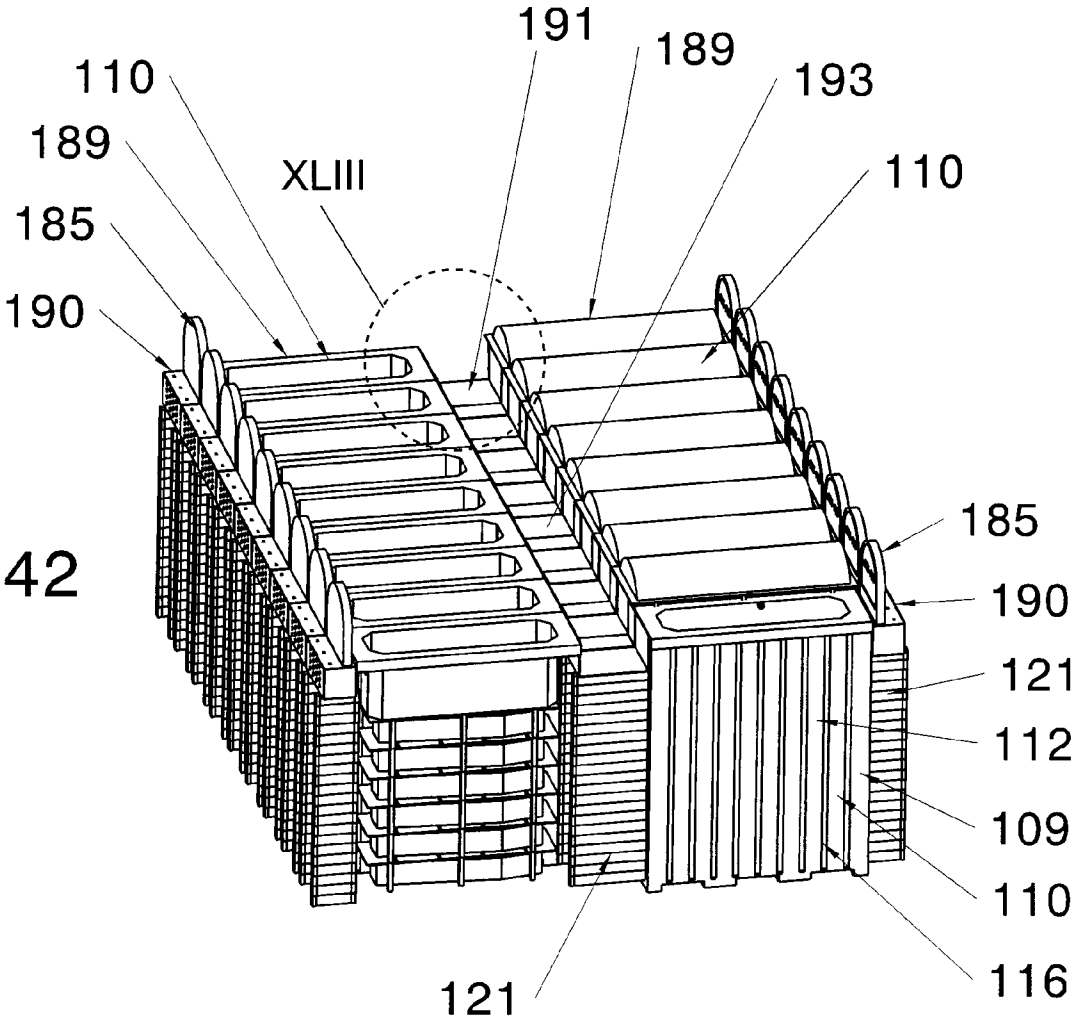
FIG. 42 shows two rows of interment systems.
Figure 43:
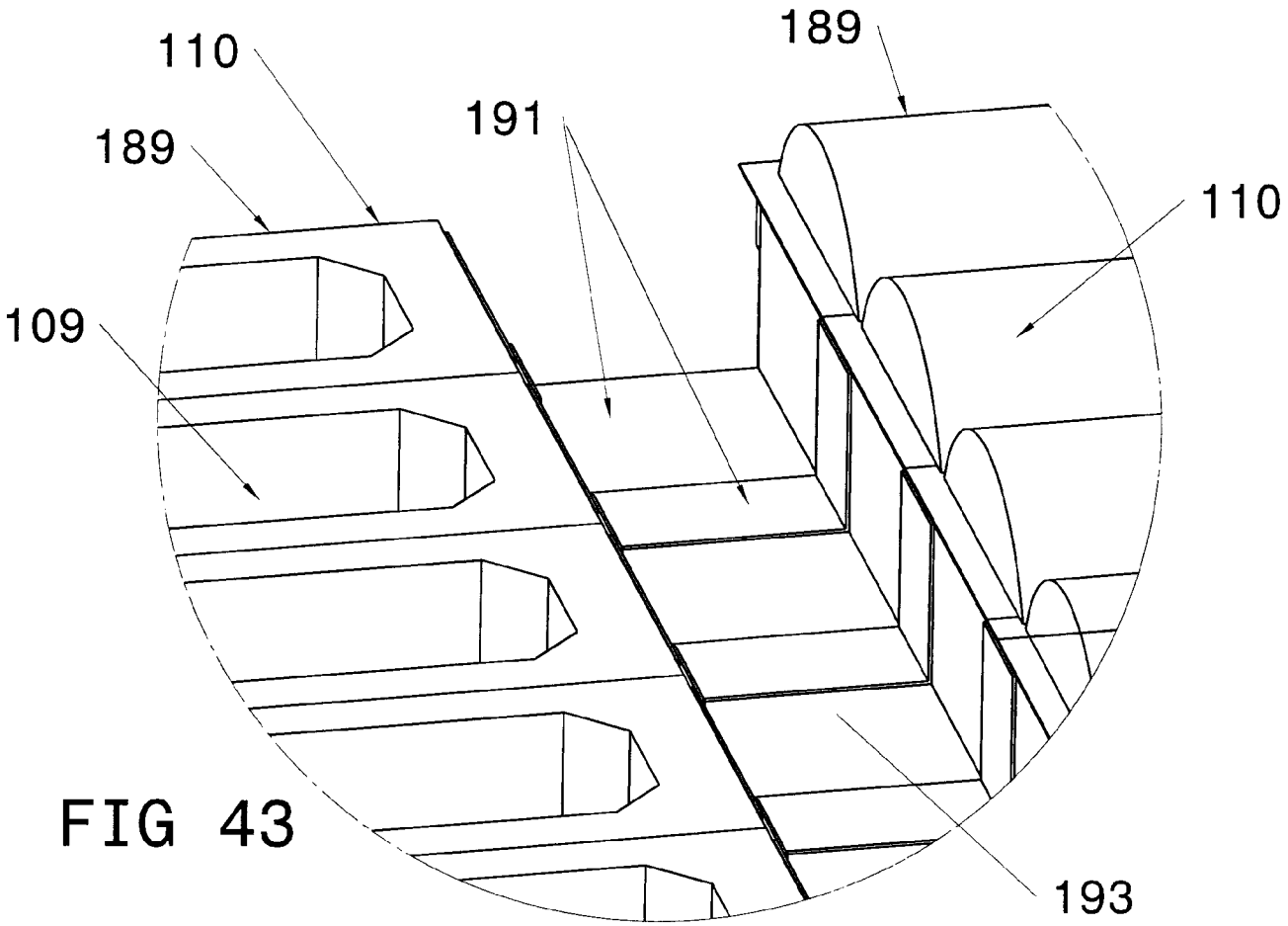
FIG. 43 is a close up of the region marked XLIII in FIG. 42.

In use, a plurality of the interment systems 110 are installed in the ground (see FIGS. 42 and 43). This is achieved by initially digging a long trench which is of such a size to receive the plurality of interment systems 110 adjacent one another. When the trench has been dug, an outer interment container 112 of first of the interment systems 110 is disposed therein. A plurality of the connecting members 117 are then received in the dovetail recesses 116 in one of the outer side walls 114A, or 114B of the outer interment container 112.

Figure 38:
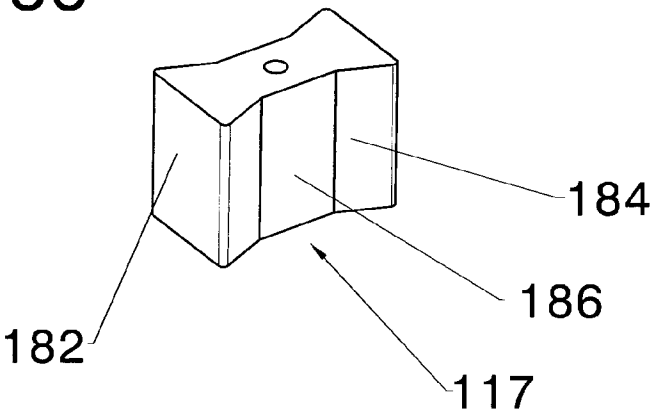
FIG. 38 is a perspective view of a connecting member.
Figure 39:
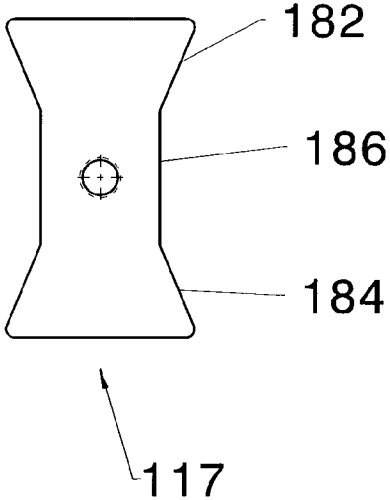
FIG. 39 is a top view of the connecting member shown in FIG. 37.

One of the connecting members 117 is shown in FIGS. 38 and 39 and comprises a pair of dovetail portions 182, 184 attached to each other at a central region 186. Each dovetail portion 182, 184 tapers outwardly from the central region 186. One of the dovetail portions (e.g. dovetail portion 182) of each of the plurality of connecting members 117 is received in the dovetail recesses 116 of the first outer container 112. When the connecting members 117 are stacked upon one another with the dovetail portions 182 of each connecting member 117 received in the recesses 116, the outer interment container 112 of the second interment system 110 can then be lowered into position adjacent the outer interment container 112 of the first interment system 110.

The lowering of the outer interment container 112 of the second interment system 110 into its position alongside the outer interment container 112 of the first interment system 110 is carried out so that the other dovetail portions 184 of each of the connecting members 117 are received in corresponding recesses 116 of the outer interment container 112 of the second interment system 110. Thus, the outer containers 112 of each of the first and second interment systems 110 are connected to one another by the connecting members 117. If it is desired to connect adjacent interment systems 110 to one another at a greater distance apart, for example to connect parallel rows 189 (see FIG. 42) of the interment systems 110 to one another at the front or rear walls 114B of the outer containers 112, further connecting members generally designated 121 can be used.

The further connecting members 121 are shown in FIGS. 40 and 41 and are similar to the connecting members shown in FIGS. 38 and 39, but the two dovetail portions 182, 184 are spaced from one another by an elongate extension portion 188. Thus, when the interment systems 110 are connected together by the further connecting members 121, they are spaced further from each other than when connected by the use of the first mentioned connecting members 117.

If desired, a path can be formed between adjacent rows 189 of interment systems 110. The adjacent rows 189 of interment systems 110 are connected to each other by the further connecting members 121 extending therebetween. A plurality of U shaped gutter members 191 are arranged one after the other on the uppermost further connecting members 121 between the two adjacent rows 189 shown in FIGS. 42 and 43. The plurality of U shaped gutter members 191 so arranged to form a channel 193, into which concrete can be poured. The concrete is allowed to set, and gravel or other suitable material can be arranged on the concrete to provide the path.

Figure 44:
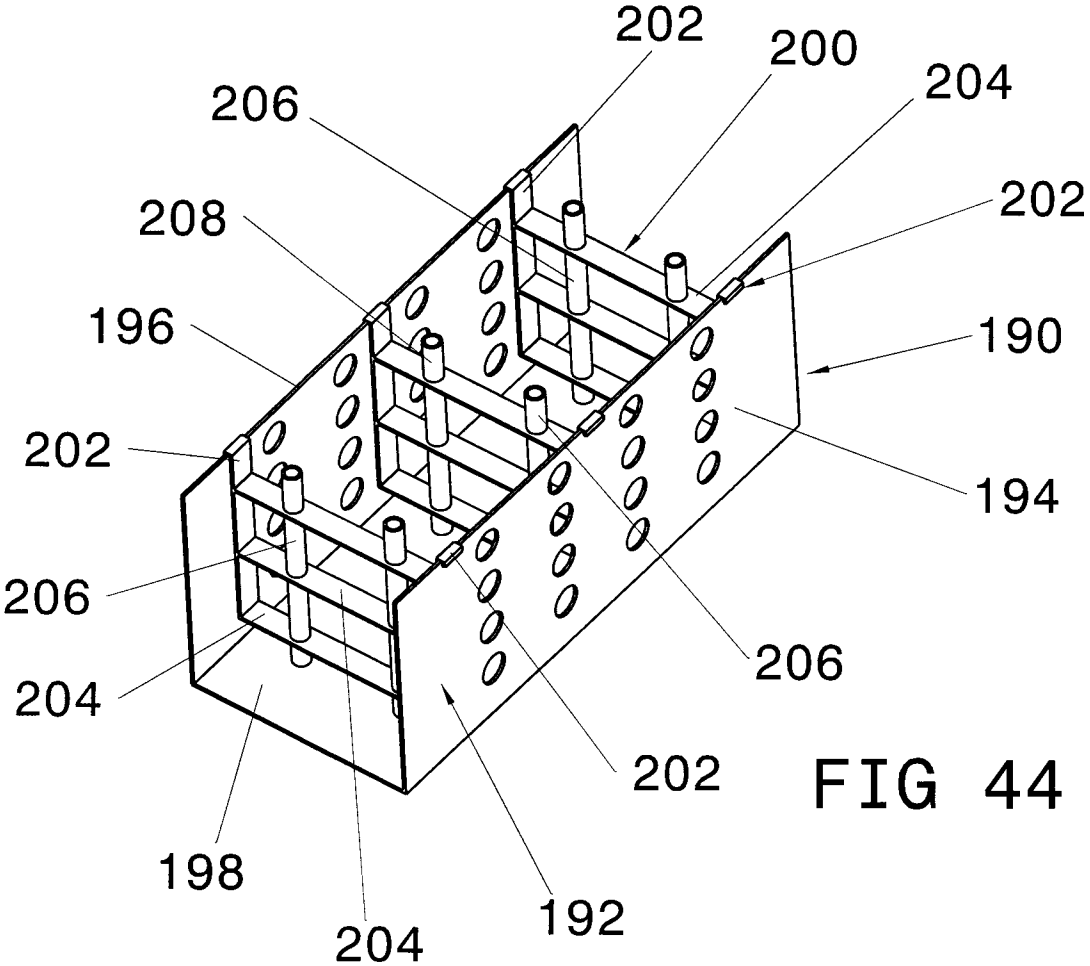
FIG. 44 is a perspective view of an embodiment of an anchor system.
Figure 45:
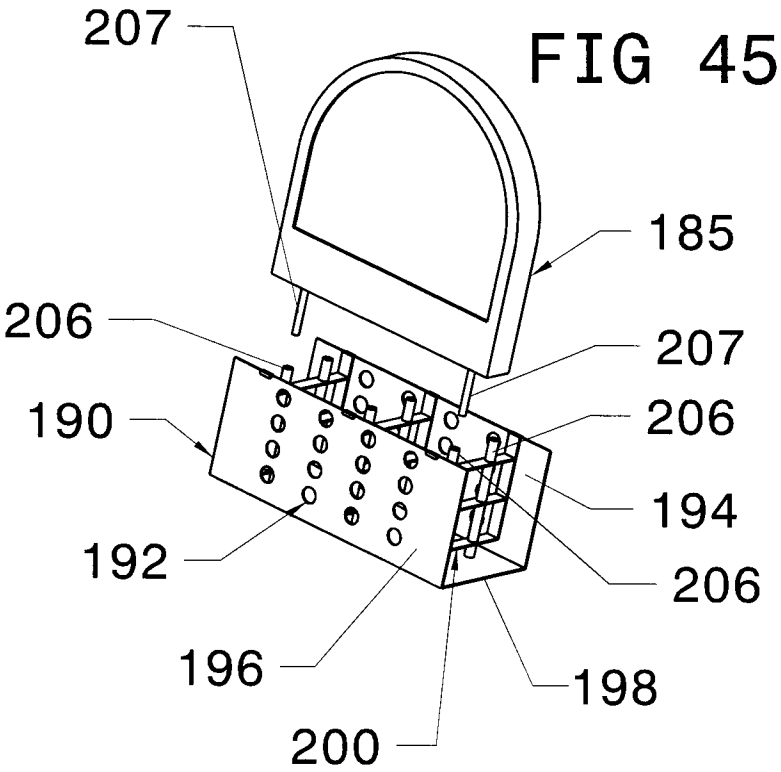
FIG. 45 shows the anchor system shown in FIG. 44 and a grave stone.

If it is desired to mount a gravestone 185 adjacent one or more of the container arrangements 109 in a row 189, an anchor system 190, as shown in FIG. 42, and in more detail in FIGS. 44, can be used. In FIG. 42, a plurality of the anchor systems 190 are disposed adjacent the container arrangements 109, with a respective anchor system 190 being arranged adjacent each of the container arrangements 109. Each anchor system 190 comprises a generally 'U' shaped holding member 192 having opposed upright side members 194, 196, and a base member 198. The anchor system 190 also includes three mounting devices 200, each comprising a pair of substantially parallel opposed carrying members 202 and three elongate struts 204 extending between the carrier members 202.

A pair of guide members 206 extend through the struts 204, each guide member 206 defining a bore 208 therethrough, the purpose of which is described below.

Figure 46:
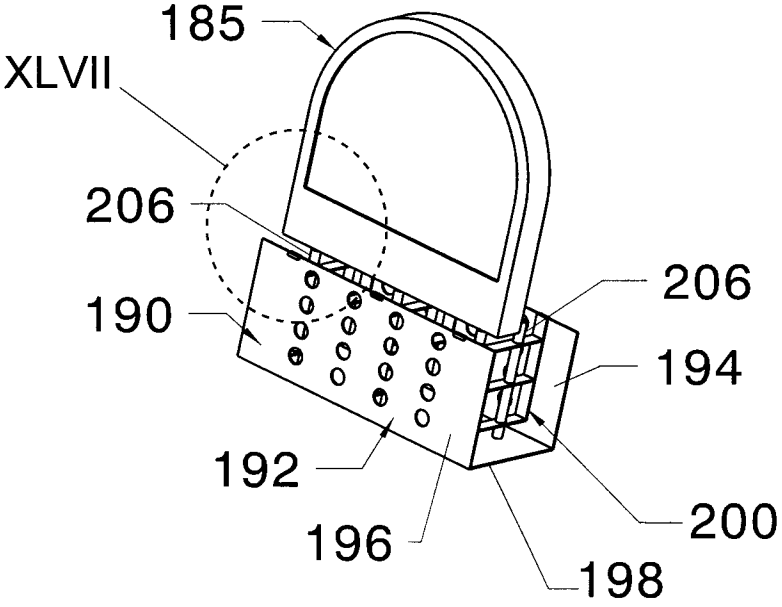
FIG. 46 is a view similar to FIG. 45, but with the grave stone held by the anchor system.
Figure 47:
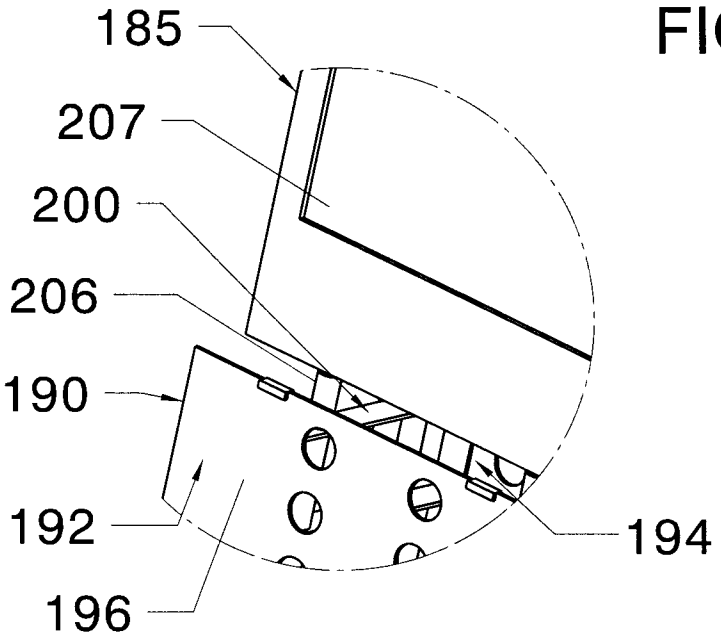
FIG. 47 is a close up of the region marked XLVII in FIG. 46.

The gravestone 185 is provided with two downwardly extending tines 207 which are of a suitable diameter to be received in the bores 208 defined by the guide members 206 In order to mount the gravestone 185 to the anchor system 190, the tines 207 are received in one of the guide members 206 of each of the outermost mounting devices 200. With the tines 207 so received, the gravestone 185 is seated on the guide members 206, as shown in FIGS. 46 and 47. Concrete or other suitable securing material can then be disposed within the holding member 192 to firmly secure the gravestone 185 thereto.

FIGS. 48 to 50 show a support for supporting a coffin within the inner interment container 150. The support is in the form of a spacing arrangement 209 and comprises a support platform 210 which comprises a generally planar member 212 and a plurality of parallel elongate raised members 214 on the planar member 212. Each spacing arrangement 209 further includes a plurality of downwardly extending load bearing member 216 on the support platform 210. The purpose of the load bearing members 216 is to engage the inner base 152 of the inner interment container 150, or the spacing arrangement 209 directly below.

Figure 51:
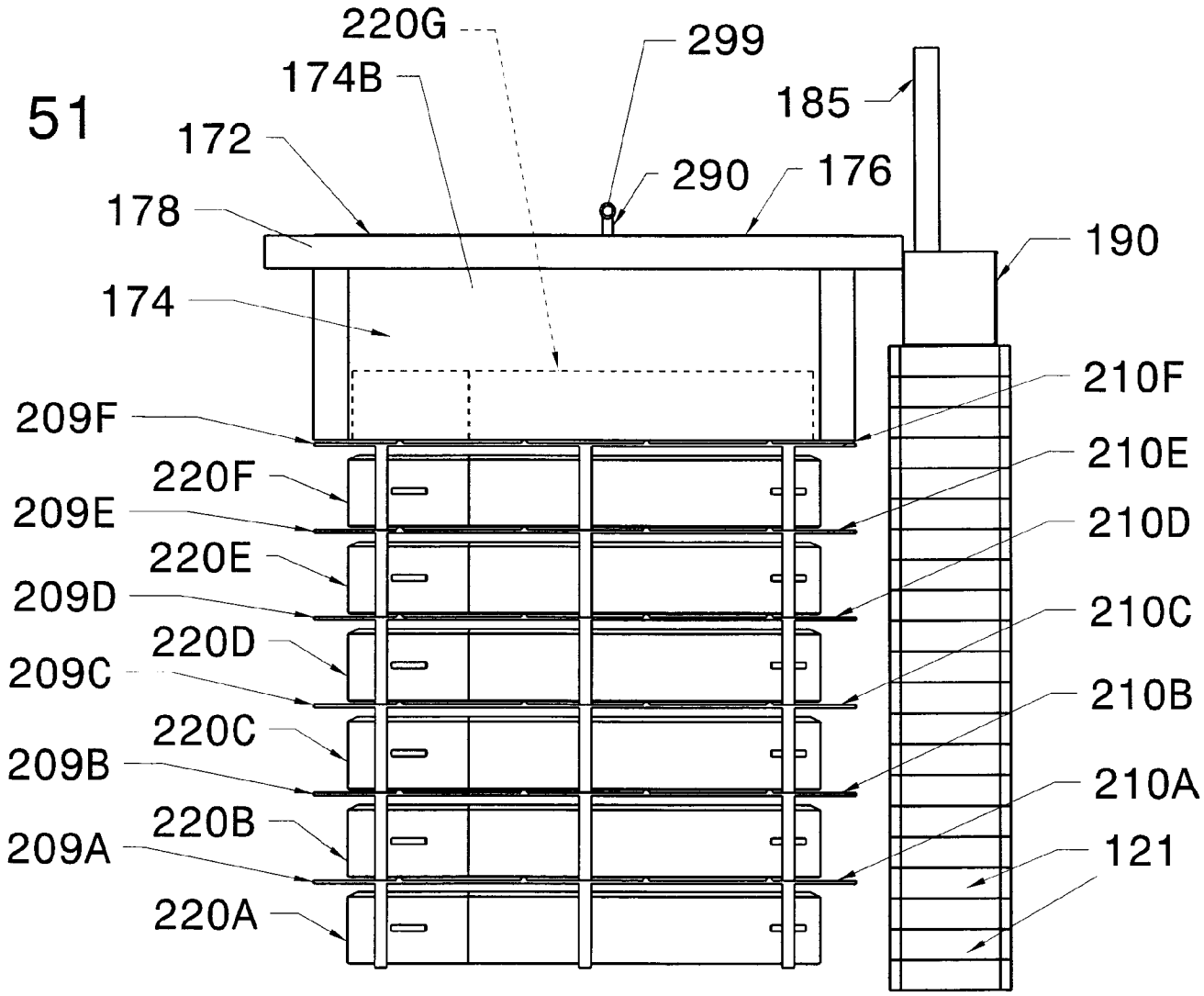
FIG. 51 is a side view of an interment system, but with the inner and outer interment containers omitted for clarity.

Referring to FIG. 51 there is shown an interment system 110 having a plurality of coffins 220 disposed therein. For reasons of clarity, the inner and outer interment containers 112 and 150 have been omitted from FIG. 51. In use, six coffins 220, designated 220A to 220F are arranged within the inner interment container 150. The first coffin 220A is arranged on the inner base 152, and a first spacing arrangement 209A is arranged over the first coffin 220A. A second coffin 220B is arranged on the support platform 210A of the first spacing arrangement 210A, and a second spacing arrangement 209B is arranged on the first spacer arrangement. A third coffin 220C is arranged on the platform 210B of the second spacer arrangement 209B. Further spacing arrangements 209C to 209F are arranged upon one another until all of the coffins 220A, 220B have been disposed within the inner interment container 150. The lid arrangement 172 is then disposed with the insertion member received by the inner interment container 150. The insertion member 174 engages the platform 209F and a seventh coffin 220G (shown in broken lines in FIG. 51) is disposed within the insertion member 174.

Figure 52:
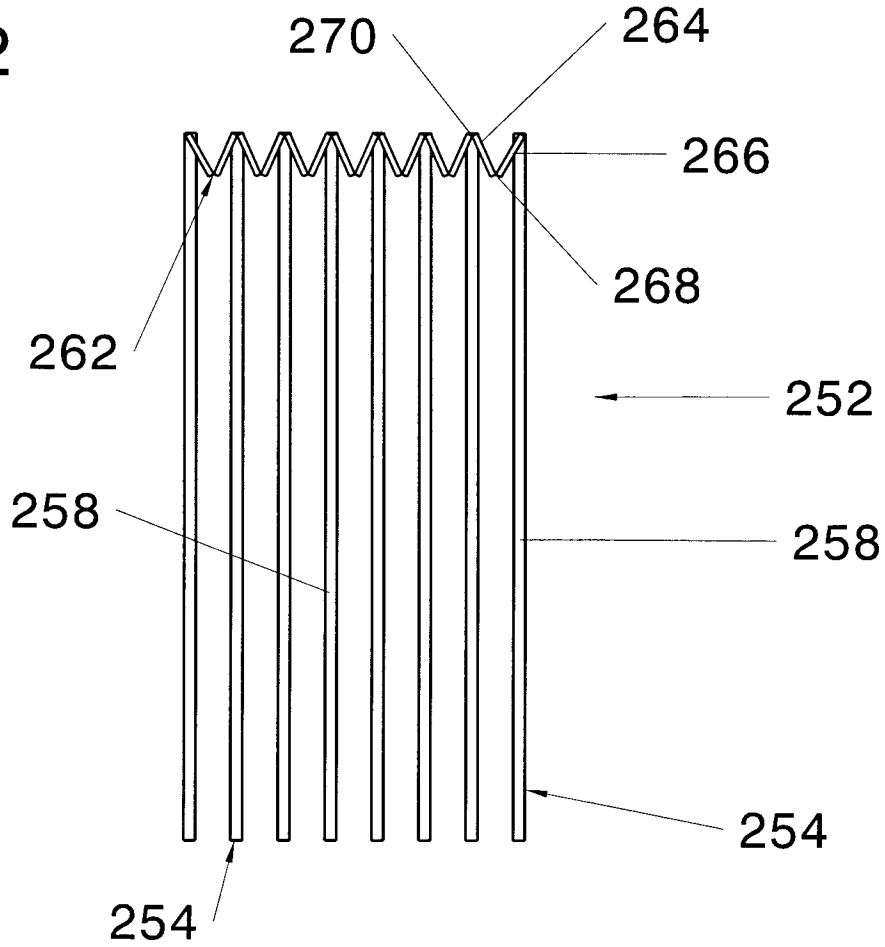
FIG. 52 is a side view of another embodiment of an inner interment container.
Figure 53:
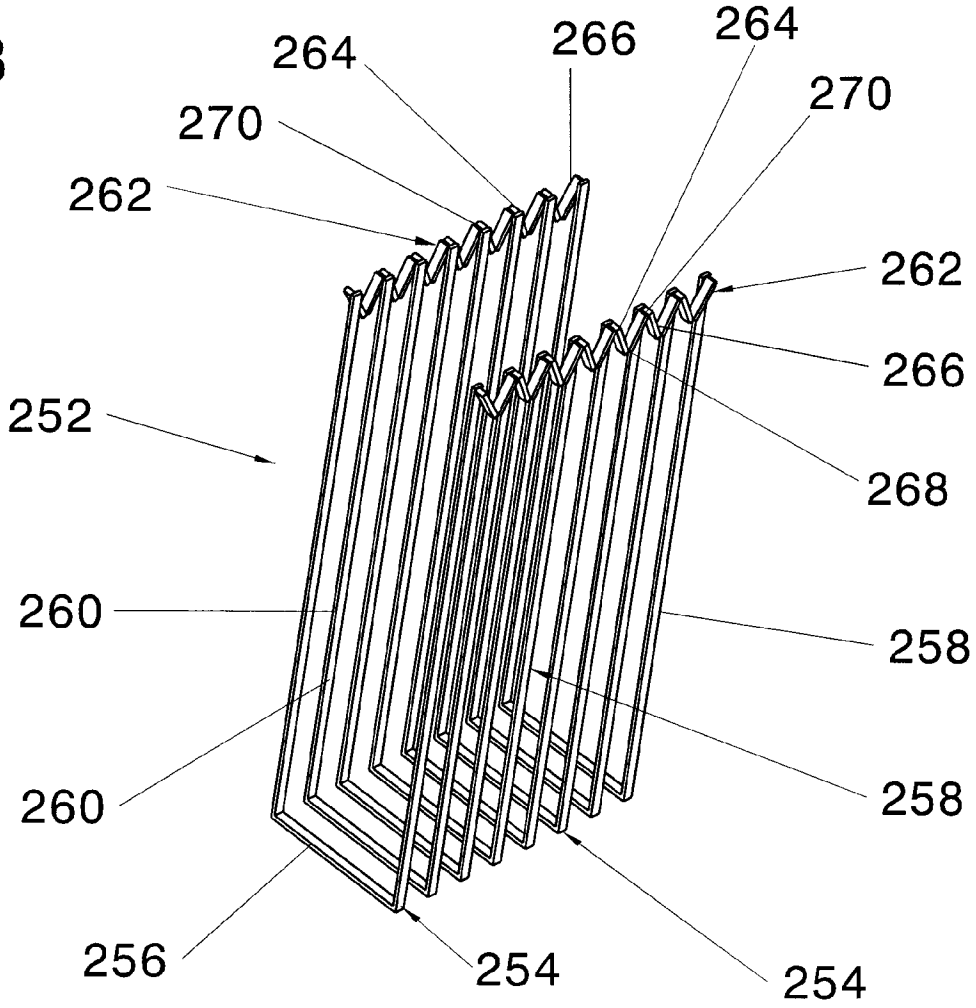
FIG. 53 is a perspective view of the inner interment container shown in FIG. 51.

FIGS. 52 and 53 show an alternative inner interment container 252, which is collapsible, and comprises a plurality of U shaped elements 254. Each of the U shaped elements 254 comprises an elongate base element 256, and two upstanding elements 258, 260 extending upwardly from opposite ends of the base element 256. The U shaped elements 254 are arranged adjacent one another, with the base elements 256 of each U shaped element extending parallel to each other, and with the upstanding elements 258, 260 of each U shaped element 254 extending parallel to each other. Adjacent U shaped elements 254 are connected to each other by foldable connecting means 262, each of which comprises first and second connecting elements 264, 266, which are foldably attached to one another by a hinge 268.

Each connecting means 262 is foldably attached to the, or each, adjacent connecting means 262 by a second hinge 270. Each second hinge 270 is mounted on a respective one of the upstanding elements 258, 260, thereby allowing the U shaped elements 254 to be collapsed onto one another by folding the connecting elements relative to each other about the hinges 268, 270.

Figure 54:
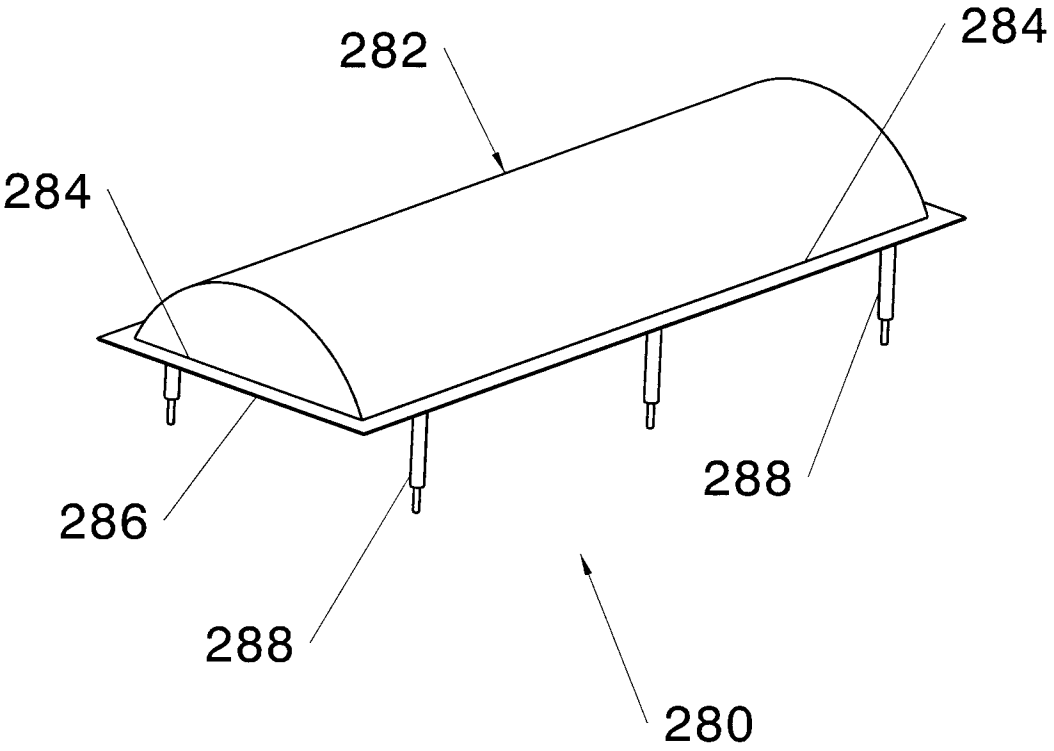
FIG. 54 is a perspective view of a hood for use in the interment system shown in FIG. 52.

FIG. 54 shows a hood 280, which can be arranged on the lid arrangement 172. The hood 280 comprises a convexly curved upper member 282, having a lower edge 284. A rectangular flange portion 286 extends outwardly from the curved upper member 282 at the lower edge 284. Connecting rods 288 extend downwardly from the flange portion 286, and can be received in corresponding apertures 288 in the flange element 177 of the lid arrangement 172 (see FIG. 34).

In use, where a coffin 220 is arranged within the insertion member 174 of the lid arrangement 172, for example as shown in FIG. 51, A spacing arrangement 209 is arranged over the coffin, such that the platform 210 is disposed above the coffin 220. The coffin 220 is sealed within the insertion member 172 by the use of concrete. Such sealing is effected by pouring concrete onto the platform 210 in the insertion member 174.

Figure 55:
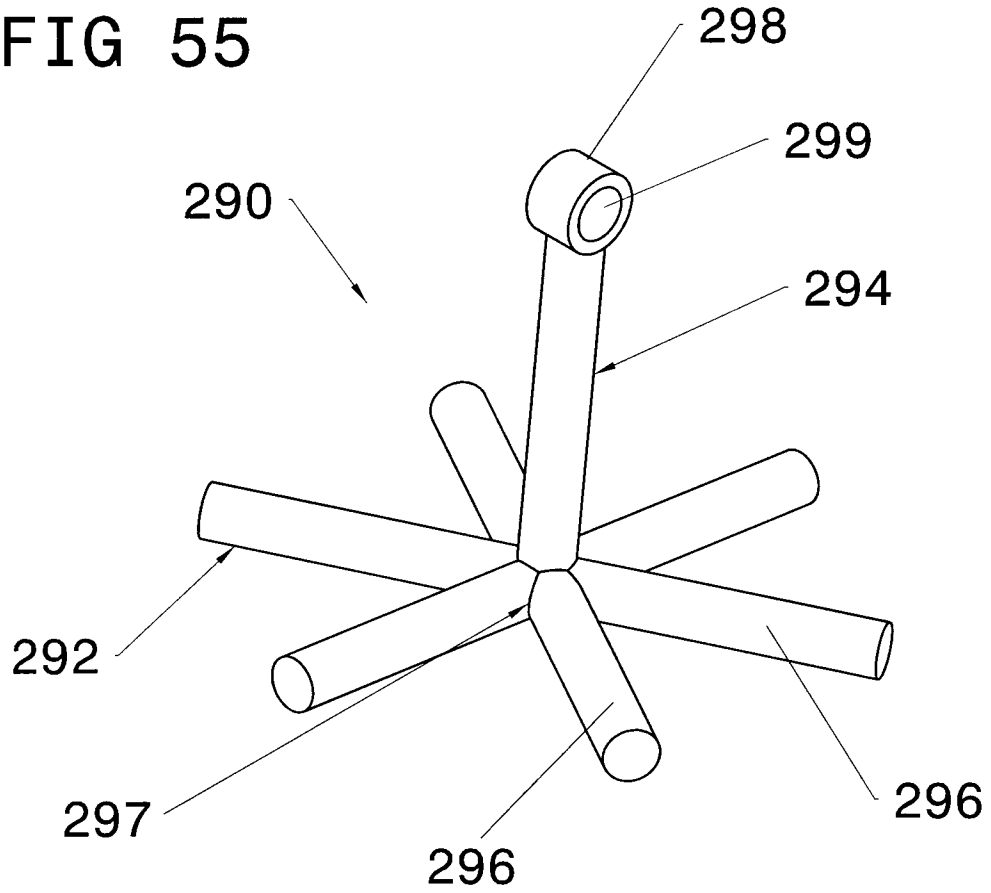
FIG. 55 shows a lifting member.
Figure 56:
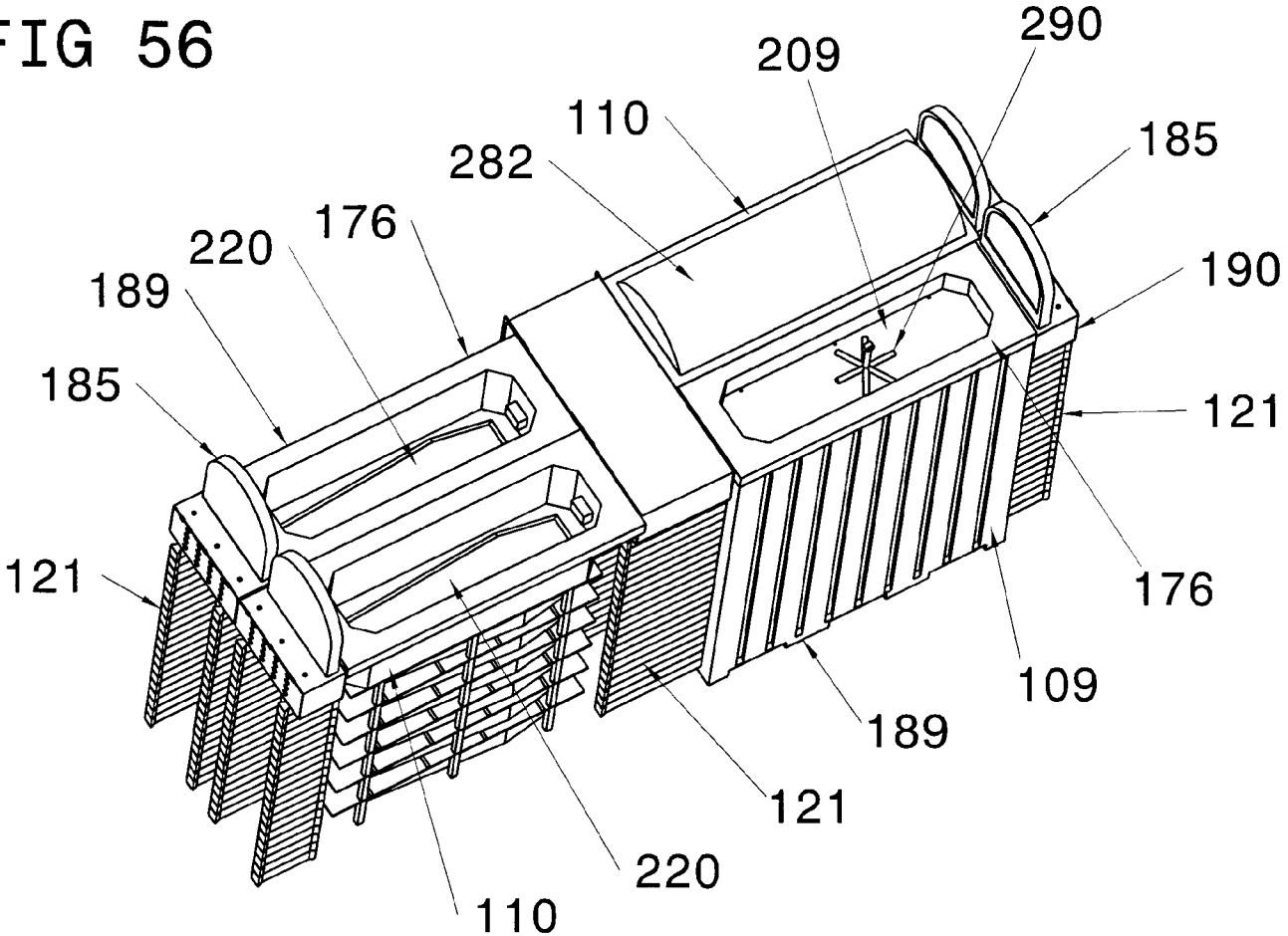
FIG. 56 shows a plurality of interment systems arranged in two rows, in which one of the interments systems shows the use of the lifting member shown in FIG. 54.

In order to facilitate removal of the concrete, if necessary at a future a date, a lifting member 290 is used. The lifting member 290 is shown in FIGS. 55 and 56, and comprises carrying means 292, and an upstanding spacer member 294 extending upwardly from the carrying means 292. The carrying means 292 comprises a plurality of radially outwardly extending elongate carrying members 296, connected to each other at a central region 297. The upstanding spacer member 294 is elongate and extends upwardly from the central region 297 of the carrying means 292. A hook receiving member 298 is provided at the upper end of the spacer member 294. The hook receiving member 298 defines an aperture 299 for receiving a hook (not shown).

The lifting member 290 is arranged on the platform 210 before the concrete is poured thereon. In this position, the hook receiving member 299 extends above the upper edge of the engagement member 176, as shown in FIG. 51. The concrete is then poured onto the platform 21, and the hood 189 can then be disposed on the lid arrangement 172. The concrete can be removed from the lid arrangement 172 by employing the use of a hook attached to a crane. The hook can be received by the aperture 299 in the hook receiving member 298 and the crane operated to lift the lifting member and, thereby, the concrete.

Figure 57:
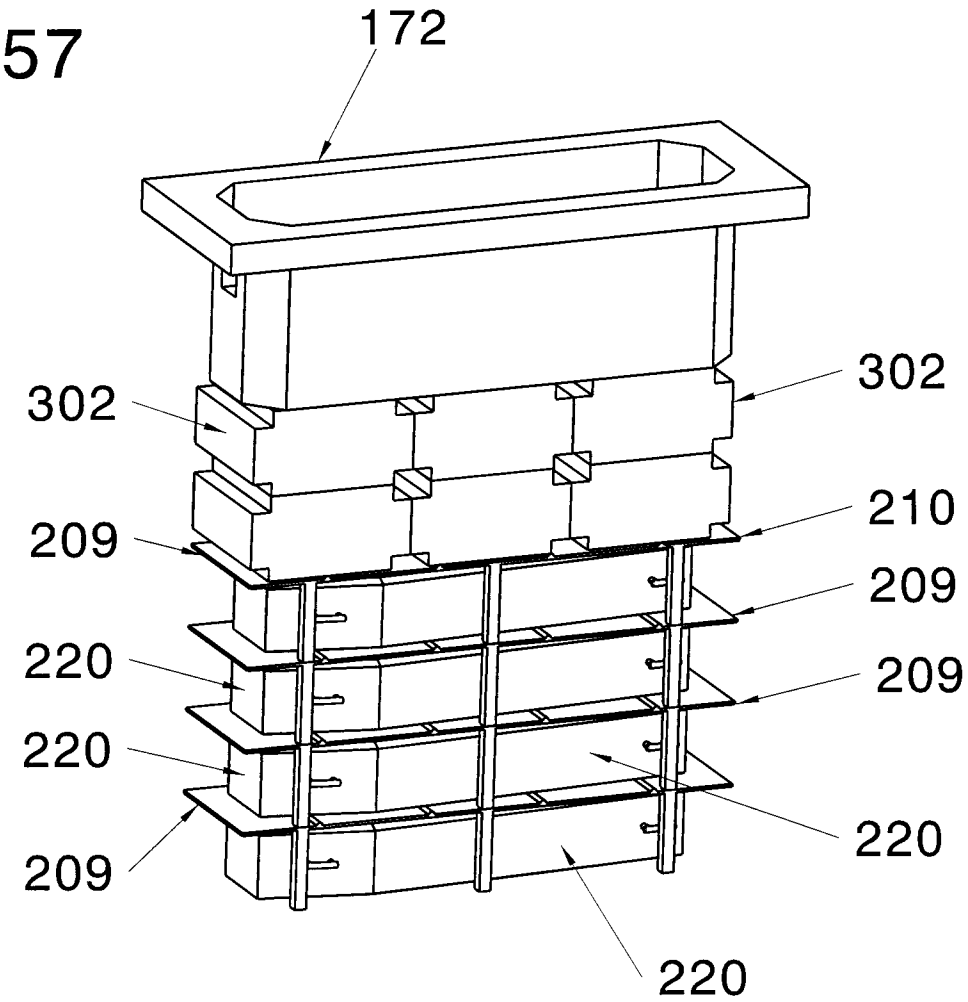
FIG. 57 shows the inside of a container arrangement showing infill members.

FIG. 57 shows the inside of a container arrangement 109, in which the container arrangement has been omitted for clarity. In FIG. 57, the inner interment container 150 is contains only four coffins 220 and four spacing arrangements 209. The support platform 210 of the upper spacing arrangement 209 supports a plurality of infill members 302 to fill the space between the upper spacing arrangement 210 and the lid arrangement 172. Thus, in FIG. 57, the lid arrangement is supported by the outer container 112 and by the infill members 302. The provision of the infill members 302 provides the advantage in the embodiments described herein that, where a container arrangement 112 is only partially filled with coffins 220, and the space above the upper most coffin 220 is with the infill members 302, it is an easy task to remove the infill members 302 if it is desired to dispose further coffins 220 in the container arrangement 109.

Figure 58:
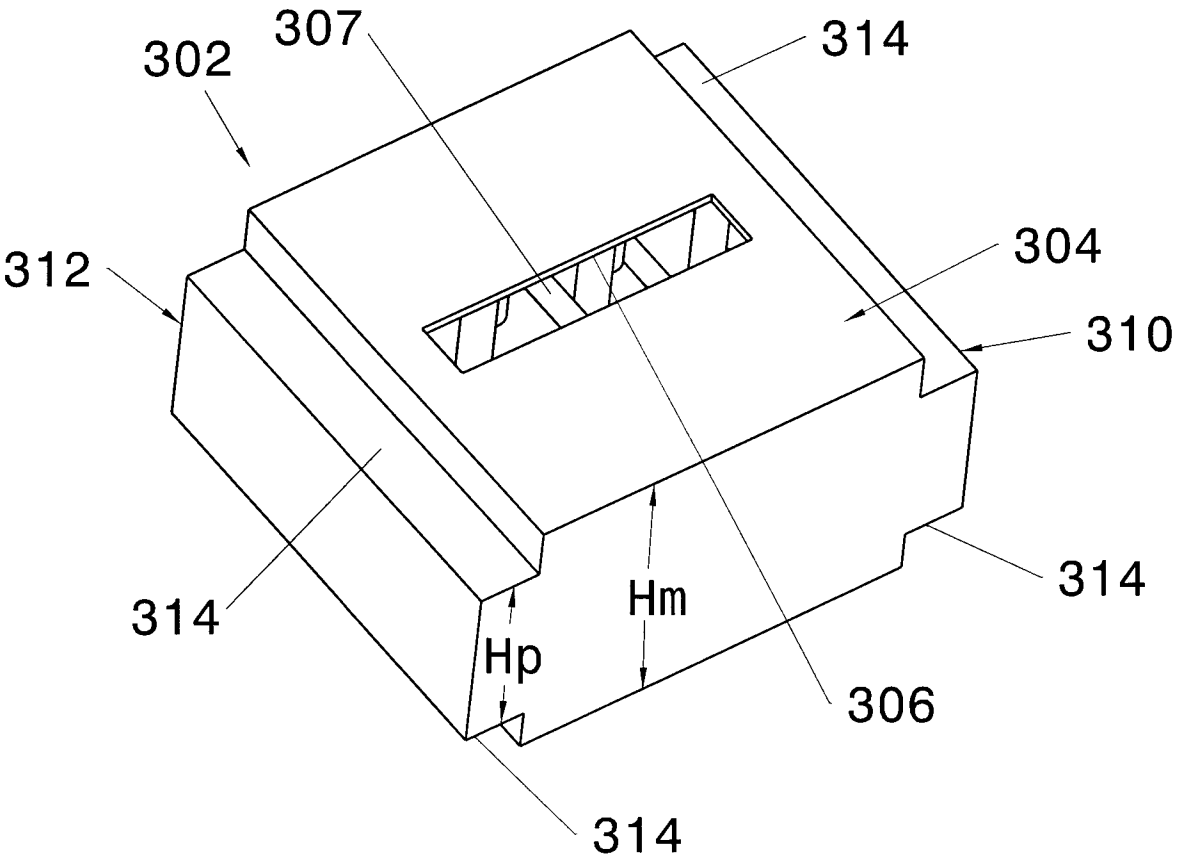
FIG. 58 is a perspective view of an infill member.
Figure 59:
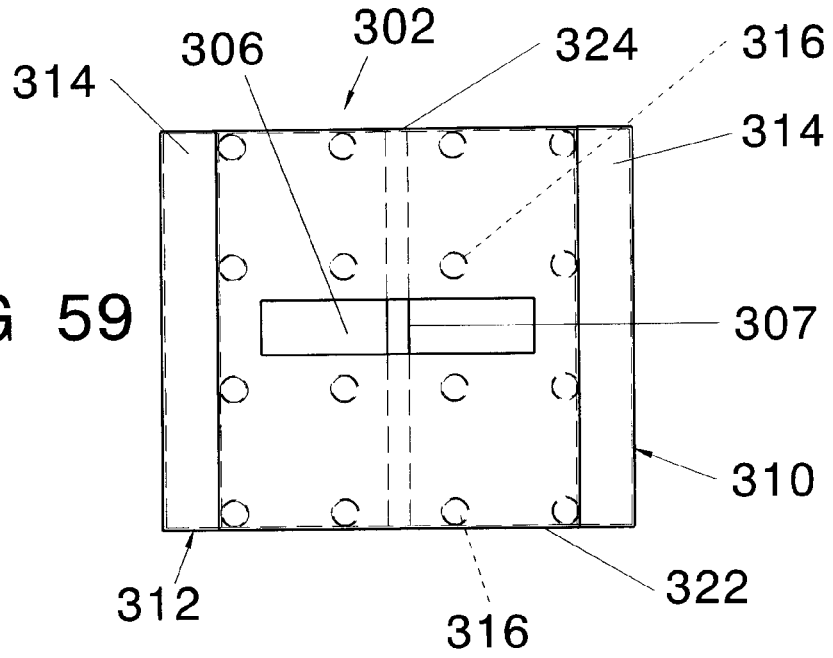
FIG. 59 is a top plan view of the infill member shown in FIG. 58.
Figure 60:
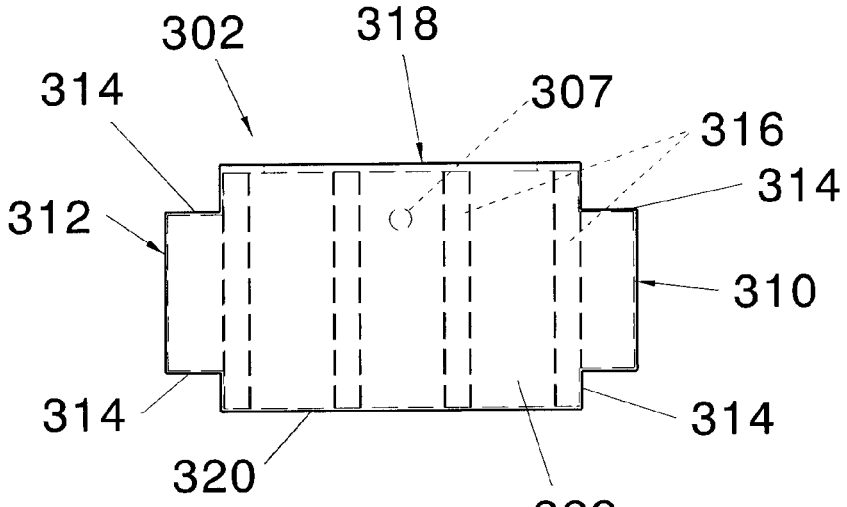
FIG. 60 is a side view of the infill member shown in FIG. 58.

FIGS. 58 to 60 show an example of one of the infill members 302. In FIG. 58, the infill member 302 comprises a casing 304 defining an aperture in the form of a slot 306, which is provided to allow access to a lifting member in the form of an elongate bar 307 provided within the casing 304. The bar 307 allows the infill member 302 to be lifted into, and out of, the container arrangement 109.

The casing 304 comprises a main part 308 and a pair of projections 310, 312 which extend from the main part 308 on opposite sides thereof. The projections 310, 312 extend centrally from said opposite sides of the main part 308, and have a height Hp which is less than the height $H_M$ of the main part 308. As a result each of the projections 310, 312 defines with the main part 308 recessed regions 314 above and below the projections 310, 312.

The infill members 302 are formed to have a suitable size and shape so that when the infill members are stacked within an inner interment container 150, the recessed regions 314 can receive the rungs 168 provided at one of the corners of the inner interment container 150. FIGS. 59 and 60 show respectively a top plan view and a side view of the infill member 302 shown in FIG. 58. The infill member 302 includes a plurality of support members 316 extending between upper and lower casing members 318, 320. The support members 316 are provided to support either further infill members 302 disposed thereon, or the lid arrangement 172. The elongate bar 307 extends between, and is attached to, opposed side casing members 322, 324.

The invention claimed is:

1. An interment system comprising a container arrangement configured to hold the posthumous remains of a plurality of individuals arranged one above the other, the container arrangement comprising an outer interment container and an inner interment container, the inner interment container being configured to be received in the outer interment container, wherein the inner interment container is formed as a one piece unit that defines a posthumous remains receiving chamber in which the remains of the plurality of individuals can be held, wherein the outer interment container comprises outer wall members defining a container receiving space to receive the inner interment container, and wherein the outer interment container includes an inwardly extending flange member extending inwardly from an upper region of the wall members over the container receiving space.

2. An interment system according to claim 1, wherein the outer interment container has an outer base from which the outer wall members extend, the outer base comprising a substantially planar outer base portion and downwardly extending foot members on the outer base portion.

3. An interment system according to claim 1, wherein the inner interment container comprises inner wall members, defining the aforesaid chamber to receive the posthumous remains, and wherein the inner interment container has an inner base arrangement from which the inner wall members extend, the inner base arrangement engaging the outer base arrangement when the inner interment container is received by the outer interment container.

4. An interment system according to claim 3, wherein the inner interment container includes an outwardly extending lip portion on an upper region of the inner wall members, the outwardly extending lip portion being provided to engage over the flange member when the inner interment container is received by the outer interment container.

5. An interment system according to claim 3, wherein the inner base arrangement includes a substantially planar main base portion and a plurality of foot members extending downwardly from the planar main base portion, the foot members being configured to engage the outer base arrangement when the inner interment container is received by the outer interment container.

6. An interment system according to claim 3, wherein the inner base arrangement includes raised members to support the lowermost remains in the inner interment container, the raised members being provided on the inner planar portion.

7. An interment system according to claim 1, wherein the outer interment container is formed as a one piece unit.

8. An interment system according to claim 1, comprising a plurality of spacing arrangements to space the posthumous remains of the individuals from each other, wherein the plurality of spacing arrangements can be stacked upon one another to space the posthumous remains of the plurality of individuals from each other, and wherein each spacing arrangement can support the posthumous remains of at least one of the individuals.

9. An interment system according to claim 8, wherein the, or each, spacing arrangement has a support platform to support the remains, each support platform comprising a planar member and includes a plurality of raised members on the planar member.

10. An interment system according to claim 1, including a connecting arrangement to connect the container arrangement to a further container arrangement, wherein the connecting arrangement comprises a plurality of connecting members, each connecting member having first and second co-operating formations to co-operate respectively with the co-operating arrangements on adjacent container arrangements.

11. An interment system according to claim 10, wherein the connecting arrangement comprises a plurality of connecting members to connect adjacent container arrangements to each other in a first orientation, and a plurality of second connecting members to connect adjacent container arrangements to each other, and wherein each of the connecting members comprises two opposed co-operating formations which can co-operate with respective adjacent container arrangements.

12. An interment system according to claim 11, wherein the container arrangement includes a co-operating arrangement to co-operate with the co-operating formations on the connecting members, the co-operating formations and the co-operating arrangement comprising co-operating dovetail members and dovetail recesses.

13. An interment system according to claim 12, including a lid arrangement for installation on the container arrangement, the lid arrangement comprising: an insertion member for insertion into the inner interment container; and an outwardly extending engagement portion to engage the outer interment container, wherein the engagement portion extends across the outer interment container, and the engagement portion includes co-operating formations to co-operate with the co-operating arrangement of the outer interment container.

14. An interment system according to claim 13, wherein the insertion member comprises a bottom member and upright wall members, the upright wall members extending from the bottom member, thereby defining a recess to receive earth, soil or other matter when the lid arrangement is installed on the container arrangement, and the insertion member including hand grips extending into the recess, the hand grips being provided to allow the lid arrangement to be manipulated into and out of the container arrangement.

15. An interment system according to claim 13, wherein the insertion member comprises a bottom arrangement and upright wall members, the bottom arrangement being telescopically received in a space defined by the upright wall members, and wherein the bottom arrangement comprises a bottom member, and upright side members extending from the bottom member, the upright side members being received in the space defined by the wall members.

16. An interment system according to claim 13, including a lifting member to lift a securing material from the lid arrangement, the lifting member comprising support means and a spacer member having a cooperating part to cooperate with a lifting element, such as a hook mounted on a crane.

17. An interment system according to claim 16, wherein the cooperating part comprises a receiving member for receiving the lifting member, wherein the spacer member is elongate and the cooperating part is disposed at one end of the spacer member, and wherein the support means comprises a plurality of carrying members extending radially from a central region, and the spacer member extends upwardly from the central region.

18. An interment system according to claim 1, including an anchor system for holding further articles, wherein the anchor system can be provided adjacent the outer interment container, the anchor system comprising a holding member, having a substantially 'U' shaped profile thereby defining a recess for receiving a mounting member of an article, wherein the anchor system includes a mounting device for mounting the article on the anchor system, the mounting device comprising a plurality of struts and a guide member held by the struts, the guide member defining a bore to receive a tine on the article.

19. An interment system according to claim 18, wherein the mounting device includes two of the aforesaid guide members, each extending through the struts, and wherein the mounting device further includes a substantially U shaped carrier member to carry the struts, the carrier member including a pair of opposed attaching hook portions to attach the mounting device to the holding member.

20. An interment system comprising a container arrangement configured to hold the posthumous remains of a plurality of individuals arranged one above the other, the container arrangement comprising an outer interment container and an inner interment container, the inner interment container being configured to be received in the outer interment container, wherein the inner interment container is formed as a one piece unit that defines a posthumous remains receiving chamber in which the remains of the plurality of individuals can be held, including a connecting arrangement to connect the container arrangement to a further container arrangement, wherein the connecting arrangement comprises a plurality of connecting members, each connecting member having first and second co-operating formations to co-operate respectively with the co-operating arrangements on adjacent container arrangements, and wherein the connecting arrangement comprises a plurality of connecting members to connect adjacent container arrangements to each other in a first orientation, and a plurality of second connecting members to connect adjacent container arrangements to each other, and wherein each of the connecting members comprises two opposed co-operating formations which can co-operate with respective adjacent container arrangements.

21. An interment system comprising a container arrangement configured to hold the posthumous remains of a plurality of individuals arranged one above the other, the container arrangement comprising an outer interment container and an inner interment container, the inner interment container being configured to be received in the outer interment container, wherein the inner interment container is formed as a one piece unit that defines a posthumous remains receiving chamber in which the remains of the plurality of individuals can be held, including an anchor system for holding further articles, wherein the anchor system can be provided adjacent the outer interment container, the anchor system comprising a holding member, having a substantially 'U' shaped profile thereby defining a recess for receiving a mounting member of an article, wherein the anchor system includes a mounting device for mounting the article on the anchor system, the mounting device comprising a plurality of struts and a guide member held by the struts, the guide member defining a bore to receive a tine on the article, wherein the mounting device includes two of the aforesaid guide members, each extending through the struts, and wherein the mounting device further includes a substantially U shaped carrier member to carry the struts, the carrier member including a pair of opposed attaching hook portions to attach the mounting device to the holding member.

* * * * *